US009534326B2

(12) United States Patent
Tokura

(10) Patent No.: US 9,534,326 B2
(45) Date of Patent: Jan. 3, 2017

(54) SEWING MACHINE AND COMPUTER-READABLE MEDIUM STORING PROGRAM

(71) Applicant: BROTHER KOGYO KABUSHIKI KAISHA, Nagoya-shi, Aichi-ken (JP)

(72) Inventor: Masashi Tokura, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 6 days.

(21) Appl. No.: 14/805,794

(22) Filed: Jul. 22, 2015

(65) Prior Publication Data

US 2016/0032508 A1 Feb. 4, 2016

(30) Foreign Application Priority Data

Jul. 31, 2014 (JP) ..... 2014-156990

(51) Int. Cl.
*D05B 19/08* (2006.01)
*D05B 39/00* (2006.01)
*D05B 21/00* (2006.01)

(52) U.S. Cl.
CPC ..... *D05B 19/08* (2013.01); *D05B 21/00* (2013.01); *D05B 39/00* (2013.01); *D05D 2205/16* (2013.01); *D05D 2207/06* (2013.01)

(58) Field of Classification Search
CPC ..... D05B 19/08; D05B 19/00; D05B 19/16; D05B 39/00; D05B 21/00; G05B 2219/2626; G05B 2219/45195; D05D 2207/06; D05D 2205/16; D05D 2207/18
See application file for complete search history.

(56) References Cited

U.S. PATENT DOCUMENTS

| | | | |
|---|---|---|---|
| 7,484,466 | B2 | 2/2009 | Kuki et al. |
| 8,606,390 | B2 | 12/2013 | Hjalmarsson et al. |
| 2007/0227420 | A1 | 10/2007 | Suzuki et al. |
| 2007/0233310 | A1 | 10/2007 | Yamada |
| 2008/0103624 | A1 | 5/2008 | Yamada |
| 2009/0188413 | A1 | 7/2009 | Hirata et al. |
| 2009/0217850 | A1 | 9/2009 | Tokura |

(Continued)

FOREIGN PATENT DOCUMENTS

| | | | |
|---|---|---|---|
| EP | 2292824 | A2 | 3/2011 |
| EP | 2 366 823 | A2 | 9/2011 |

(Continued)

OTHER PUBLICATIONS

Jul. 22, 2015 Extended Search Report issued in European Patent Application No. 15158900.9.

(Continued)

*Primary Examiner* — Ismael Izaguirre
(74) *Attorney, Agent, or Firm* — Oliff PLC

(57) ABSTRACT

The sewing machine includes an image capturing portion, a processor, and a memory. The memory is configured to store computer-readable instructions. The computer-readable instructions, when executed by the processor, cause the sewing machine to perform operations of: setting a specified range within the image capture enabled range based on a first image, acquiring a plurality of partial images, and creating a composite image by combining the acquired plurality of the partial images.

20 Claims, 11 Drawing Sheets

(56) References Cited

U.S. PATENT DOCUMENTS

| | | | | |
|---|---|---|---|---|
| 2011/0048301 | A1* | 3/2011 | Tokura | D05B 19/12 112/103 |
| 2011/0202165 | A1* | 8/2011 | Tokura | D05C 5/06 700/138 |
| 2011/0226171 | A1* | 9/2011 | Tokura | D05B 19/10 112/470.05 |
| 2011/0282479 | A1* | 11/2011 | Tokura | D05C 5/06 700/108 |
| 2012/0209417 | A1 | 8/2012 | Tokura | |
| 2013/0112127 | A1* | 5/2013 | Tokura | D05B 19/10 112/102.5 |
| 2014/0230707 | A1 | 8/2014 | Suzuki et al. | |

FOREIGN PATENT DOCUMENTS

| | | | |
|---|---|---|---|
| JP | H07-265569 | A | 10/1995 |
| JP | 2005-146460 | A | 6/2005 |
| JP | 2009-201704 | A | 9/2009 |

OTHER PUBLICATIONS

U.S. Appl. No. 14/636,739, filed Mar. 3, 2015 in the name of Masashi Tokura.

U.S. Appl. No. 14/636,633, filed Mar. 3, 2015 in the name of Mitsuhiro Iida.

Aug. 27, 2015 Extended European Search Report issued in European Patent Application No. 15158901.7.

* cited by examiner

SEWING MACHINE AND COMPUTER-READABLE MEDIUM STORING PROGRAM

CROSS-REFERENCE TO RELATED APPLICATION

This application claims priority to Japanese Patent Application No. 2014-156990, filed Jul. 31, 2014. The disclosure of the foregoing applications is incorporated herein by reference in its entirety.

FIELD OF DISCLOSURE

The present disclosure relates to a sewing machine that is provided with an image capture portion and to a computer-readable medium that stores a program.

BACKGROUND

A sewing machine that is provided with an image capture portion is known. For example, in the known sewing machine, a plurality of images (partial images), in which an object of image capture is divided into a plurality of regions, are captured by the image capture portion. The image capture portion creates a plurality of sets of image data that describe the captured partial images. By combining the plurality of the captured partial images based on the created plurality of sets of the image data, the sewing machine creates a composite image that shows all of the regions of the object of image capture.

SUMMARY

In some cases, the colors of the partial images that are described by the image data that the image capture portion has created may differ, due to factors in the environment in which the sewing machine is used (for example, differences in the brightness of the surroundings, differences in light sources, or the like). In these cases, when the sewing machine creates the composite image by combining the plurality of the partial images, there is a possibility that differences in the shading of the colors will occur at the boundaries between the partial images in the composite image.

Various embodiments of the broad principles derived herein provide a sewing machine and a program-storing computer-readable medium that are configured to acquire a composite image while inhibiting the occurrence of differences in the shading of the colors at the boundaries between the partial images.

The embodiments herein provide a sewing machine that includes an image capturing portion, a processor, and a memory. The image capture portion is configured to capture images of an object region and a color reference member. The image capture portion has an image capture enabled range that is smaller than the object region. The object region is configured such that an object of image capture is disposed within the object region. The memory is configured to store computer-readable instructions. The computer-readable instructions, when executed by the processor, cause the sewing machine to perform operations of: setting a specified range within the image capture enabled range based on a first image, acquiring a plurality of partial images, and creating a composite image by combining the acquired plurality of the partial images. The first image is an image of the color reference member that the image capture portion has captured. The plurality of the partial images are a plurality of images that the image capture portion has captured, within the specified range that has been set, of a plurality of regions that are included in the object of image capture.

The embodiments described herein also provide a non-transitory computer readable medium that stores a program. The program includes computer-readable instructions to be executed by a processor of a sewing machine. The sewing machine includes an image capturing portion. The image capture portion is configured to capture images of an object region and a color reference member. The image capture portion has an image capture enabled range that is smaller than the object region. The object region is configured such that an object of image capture is disposed within the object region. The program includes computer-readable instructions to cause the processor to perform the steps of: setting a specified range within the image capture enabled range based on a first image, acquiring a plurality of partial images, and creating a composite image by combining the acquired plurality of the partial images. The first image is an image of the color reference member that the image capture portion has captured. The plurality of the partial images are a plurality of images that the image capture portion has captured, within the specified range that has been set, of a plurality of regions that are included in the object of image capture.

BRIEF DESCRIPTION OF THE DRAWINGS

Embodiments of the present disclosure will be described below in detail with reference to the accompanying drawings in which.

DETAILED DESCRIPTION

Figure 1:
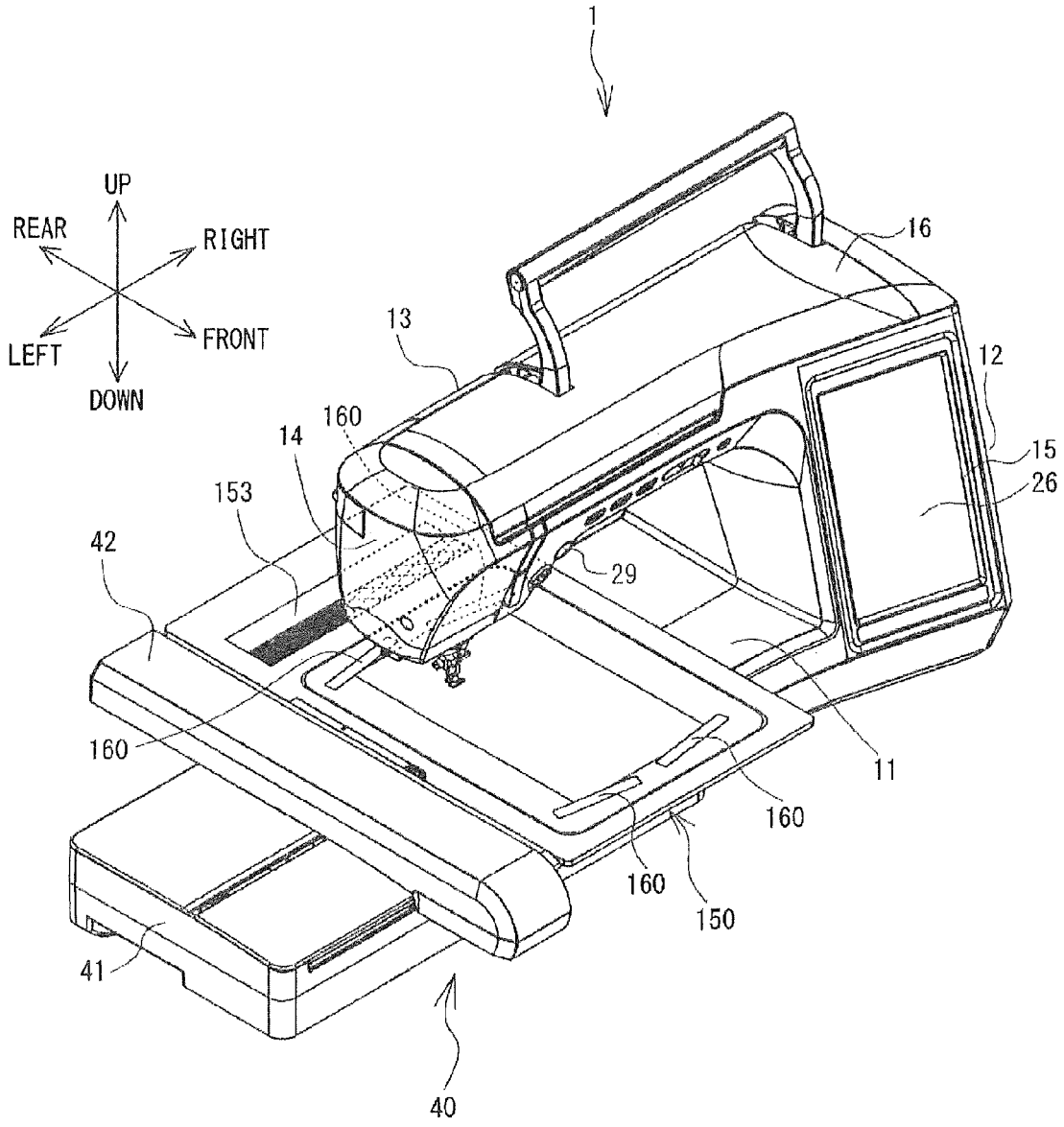
FIG. 1 is an oblique view of a sewing machine.

An embodiment of the present disclosure will be explained with reference to the drawings. A physical configuration of a sewing machine 1 will be explained with reference to FIGS. 1 and 2. The up-down direction, the lower right side, the upper left side, the lower left side, and the upper right side in FIG. 1 are respectively the up-down direction, the front side, the rear side, the left side and the right side of the sewing machine 1. In other words, the face on which is provided a liquid crystal display (hereinafter called the LCD) 15, which will be described later, is the front face of the sewing machine 1. The lengthwise directions of a bed 11 and an arm 13 are the left-right direction of the sewing machine 1. The side on which a pillar 12 is disposed is the right side of the sewing machine 1. The direction in which the pillar 12 extends is the up-down direction of the sewing machine 1.

As shown in FIG. 1, the sewing machine 1 is provided with the bed 11, the pillar 12, the arm 13, and a head 14. The bed 11 is the base portion of the sewing machine 1 that extends in the left-right direction. The pillar 12 is provided such that it extends upward from the right end of the bed 11. The arm 13 extends to the left from the upper end of the pillar 12 and faces the bed 11. The head 14 is a component that is coupled to the left end of the arm 13.

The bed 11 is provided with a needle plate 21 (refer to FIG. 2) on its top face. The needle plate 21 includes a needle hole (not shown in the drawings) through which a sewing needle 7, which will be described later, is able to pass. A sewing workpiece (for example, a work cloth) that is not shown in the drawings is placed on the top face of the needle plate 21. Underneath the needle plate 21 (that is, inside the bed 11), the sewing machine 1 is provided with a feed dog, a feed mechanism, a shuttle mechanism, and the like that are not shown in the drawings. During ordinary sewing that is not embroidery sewing, the feed dog is driven by the feed mechanism and moves the sewing workpiece by a specified feed amount. The shuttle mechanism entwines an upper thread (not shown in the drawings) with a lower thread (not shown in the drawings) below the needle plate 21.

The sewing machine 1 is also provided with a moving mechanism 40. The moving mechanism 40 is configured to be mounted on and removed from the bed 11. FIG. 1 shows a state in which the moving mechanism 40 has been mounted on the sewing machine 1. When the moving mechanism 40 is mounted on the sewing machine 1, the moving mechanism 40 and the sewing machine 1 are electrically connected. The moving mechanism 40 is provided with a body portion 41 and a carriage 42. The carriage 42 is provided on the top side of the body portion 41. The carriage 42 has a three-dimensional rectangular shape whose long axis extends in the front-rear direction. The carriage 42 is provided with a frame holder (not shown in the drawings), a Y axis moving mechanism (not shown in the drawings), and a Y axis motor 84 (refer to FIG. 5). The frame holder is provided on the right side face of the carriage 42. One embroidery frame that has been selected from among a plurality of types of embroidery frames with different sizes and shapes or the holder member 150 can be removably mounted on the frame holder. The Y axis moving mechanism moves the frame holder in the front-rear direction (the Y axis direction). The Y axis motor 84 drives the Y axis moving mechanism.

The embroidery frame in the present embodiment (not shown in the drawings) has the same sort of configuration as a known embroidery frame. The embroidery frame includes a first frame member and a second frame member that are not shown in the drawings. The embroidery frame is configured to hold the sewing workpiece using the first frame member and the second frame member. A sewing-enabled area that is defined on the inner side the embroidery frame is an area in which stitches can be formed. The holder member 150 is a member that holds an object of image capture by an image sensor 35 and will be described in detail later.

The body portion 41 is provided with an X axis moving mechanism (not shown in the drawings) and an X axis motor 83 (refer to FIG. 5) in its interior. The X axis moving mechanism moves the carriage 42 in the left-right direction (the X axis direction). The X axis motor 83 drives the X axis moving mechanism. The moving mechanism 40 is configured to move the one of the embroidery frame and the holder member 150 that is mounted on the carriage 42 (specifically on the frame holder) to a position that is indicated by an XY coordinate system (an embroidery coordinate system) that is specific to the sewing machine 1. In the embroidery coordinate system, for example, the rightward direction, the leftward direction, the forward direction, and the rearward direction in the sewing machine 1 are equivalent to a positive X axis direction, a negative X axis direction, a negative Y axis direction, and a positive Y axis direction.

The LCD 15 is provided on the front face of the pillar 12. An image that includes various types of items, such as commands, illustrations, setting values, messages, and the like, is displayed on the LCD 15. A touch panel 26 that is configured to detect a pressed position is provided on the front face of the LCD 15. When a user uses a finger or a stylus pen (not shown in the drawings) to perform a pressing operation on the touch panel 26, the pressed position is detected by the touch panel 26. Based on the pressed position that was detected, a CPU 61 of the sewing machine 1 (refer to FIG. 5) recognizes the item that was selected within the image. Hereinafter, the pressing operation on the touch panel 26 by the user will be called a panel operation. By performing a panel operation, the user can select a pattern to be sewn, a command to be executed, and the like. The pillar 12 is provided with a sewing machine motor 81 (refer to FIG. 5) in its interior.

A cover 16 that is configured to be opened and closed is provided in the upper part of the arm 13. FIG. 1 shows the cover 16 in a closed state. A spool containing portion (not shown in the drawings) is provided under the cover 16 (that is, in the interior of the arm 13). The spool containing portion is configured to contain a thread spool (not shown in the drawings) on which the upper thread is wound. A drive shaft (not shown in the drawings) that extends in the left-right direction is provided in the interior of the arm 13. The drive shaft is rotationally driven by the sewing machine motor 81. Various types of switches that include a start/stop switch 29 are provided in the lower left portion of the front face of the arm 13. The start/stop switch 29 is a switch for starting and stopping the operation of the sewing machine 1. That is, the user uses the start/stop switch 29 to input commands to start sewing and stop sewing.

Figure 2:
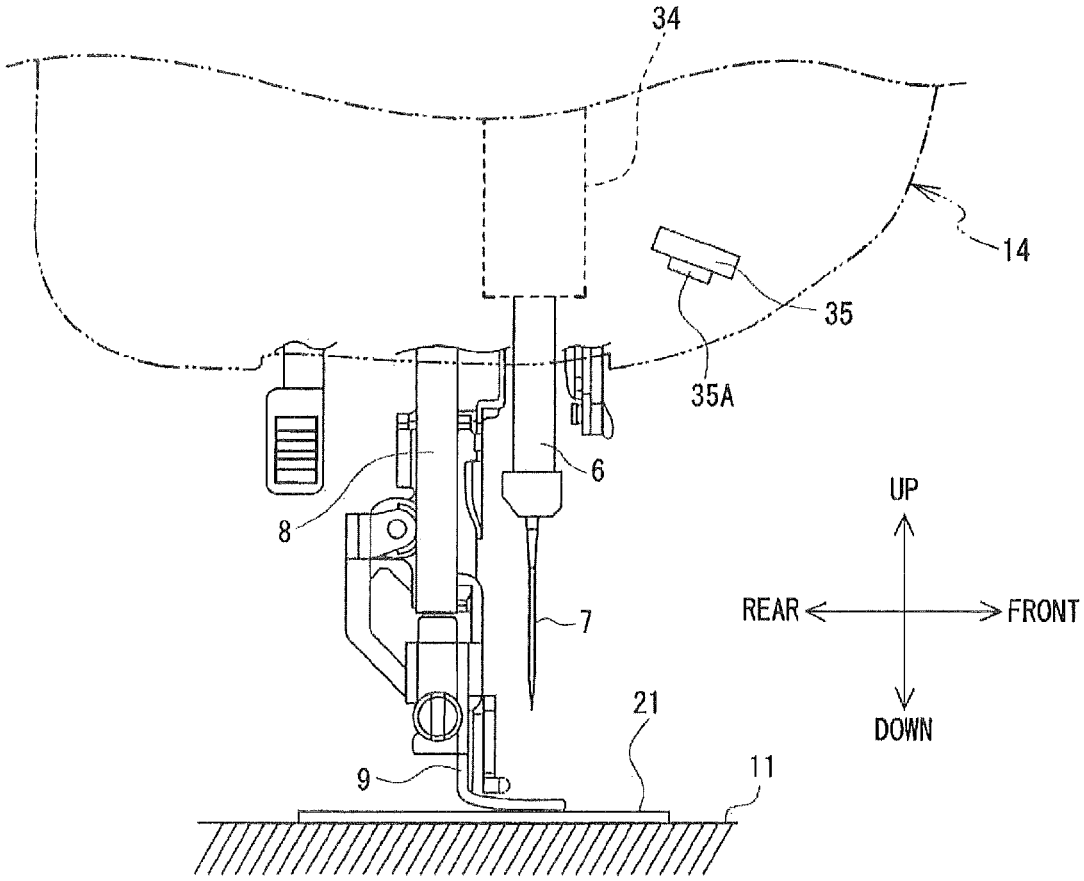
FIG. 2 is an explanatory figure that shows the configuration of a lower end portion of a head.

As shown in FIG. 2, a needle bar 6, a presser bar 8, a needle bar up-down drive mechanism 34, and the like are provided in the head 14. The needle bar 6 and the presser bar 8 extend downward from a lower end portion of the head 14. The sewing needle 7 is removably mounted on the lower end of the needle bar 6. A presser foot 9 is removably mounted on the lower end of the presser bar 8. The needle bar 6 is provided on lower end of the needle bar up-down drive mechanism 34. The needle bar up-down drive mechanism 34 drives the needle bar 6 up and down in accordance with the rotation of the drive shaft.

The image sensor 35 is provided in the interior of the head 14. The image sensor 35 is a known complementary metal oxide semiconductor (CMOS) image sensor, for example. The image sensor 35 is a known area sensor in which a plurality of image capture elements 35A (for example, a plurality of CMOS elements) that are arrayed in a main scanning direction are disposed in a plurality of columns in an auxiliary scanning direction. In the present embodiment, the main scanning direction and the auxiliary scanning direction are respectively equivalent to the X axis direction (the left-right direction) and the Y axis direction (the front-rear direction) of the sewing machine 1.

The entire range for which the image sensor 35 captures an image in one round of image capture will be called an image capture enabled range H1. In the image sensor 35 in the present embodiment, the number of the image capture elements 35A that are arrayed in the main scanning direction is greater than the number of the image capture elements 35A that are arrayed in the auxiliary scanning direction. In other words, the number of pixels in the main scanning direction is greater than the number of pixels in the auxiliary scanning direction, so the image capture enabled range H1 is a rectangle that is longer in the main scanning direction than in the auxiliary scanning direction. As an example, the image sensor 35 in the present embodiment is an area sensor that has 1280 pixels in the main scanning direction and 720 pixels in the auxiliary scanning direction. The image capture enabled range H1 is smaller than an image capture object region R (refer to the dashed-two dotted lines in FIG. 3), which will be described later.

Within the image capture enabled range H1, a range that is used by image processing in main processing (refer to FIG. 6), which will be described later, will be called a unit image capture range H2 (refer to the broken lines in FIG. 3). The unit image capture range H2 in the present embodiment is a portion of the image capture enabled range H1, but it may also be the same size as the image capture enabled range H1. As an example, a reference size (that is, an initial value) of the unit image capture range H2 is 1000 dots in the main scanning direction and 600 dots in the auxiliary scanning direction. In the main processing (refer to FIG. 6), the sewing machine 1 is able to change the size of the unit image capture range H2, but this will be described in detail later. Note that the number of the dots in the auxiliary scanning direction of the unit image capture range H2 needs only to be at least one.

The image sensor 35 is disposed such that it can capture an image of an area that includes the area below the needle bar 6. The image sensor 35 is configured to create and output image data for an image that is captured within the image capture enabled range H1. The image data that are output are stored in a specified storage area in a RAM 63 (refer to FIG. 5). An image coordinate system that is described by the image data that the image sensor 35 has created and a coordinate system for all of space (hereinafter also called the world coordinate system) are correlated in advance by parameters that are stored in a flash memory 64 (refer to FIG. 5). The world coordinate system and the embroidery coordinate system are correlated in advance by parameters that are stored in the flash memory 64. The sewing machine 1 is therefore able to perform processing that specifies coordinates in the embroidery coordinate system based on the image data that the image sensor 35 has created.

The image sensor 35 in the present embodiment has a function that creates the image data with the white balance corrected. More specifically, the image sensor 35 has an auto white balance function (hereinafter called the AWB) and a manual white balance function (hereinafter called the MWB). The AWB is a function that performs color temperature correction on the image data using determined white balance values (hereinafter called the determined WB values). The determined WB values are white balance values that are determined based on color information in the image data. The MWB is a function that performs color temperature correction on the image data using set white balance values (hereinafter called the set WB values). The set WB values are white balance values that are set by the CPU 61. The color information is information that describes color. In the present embodiment, the color information is expressed in the form of gradation values (numerical values from 0 to 255) for the three primary colors red (R), green (G), and blue (B).

The holder member 150 that is configured to be mounted on the moving mechanism 40 (refer to FIG. 1) will be explained with reference to FIGS. 3 and 4. The left-right direction, the top side, and the bottom side in FIGS. 3 and 4 respectively define the left-right direction, the rear side, and the front side of the holder member 150. The holder member 150 is a rectangular plate member whose long axis extends in the front-rear direction in a plan view. The short side direction of the holder member 150 is the left-right direction of the holder member 150. The side of the holder member 150 on which a mounting portion 152 that will be described later is provided is the left side of the holder member 150. The long side direction of the holder member 150 is the front-rear direction of the holder member 150. The side of the holder member 150 on which a color reference member 153 that will be described later is provided is the rear side of the holder member 150. The holder member 150 in the present embodiment is used in a case where an image of a sheet-shaped object, for example, will be captured by the image sensor 35. The sheet-shaped object may be a paper, a work cloth, or a resin sheet, for example.

Figure 3:
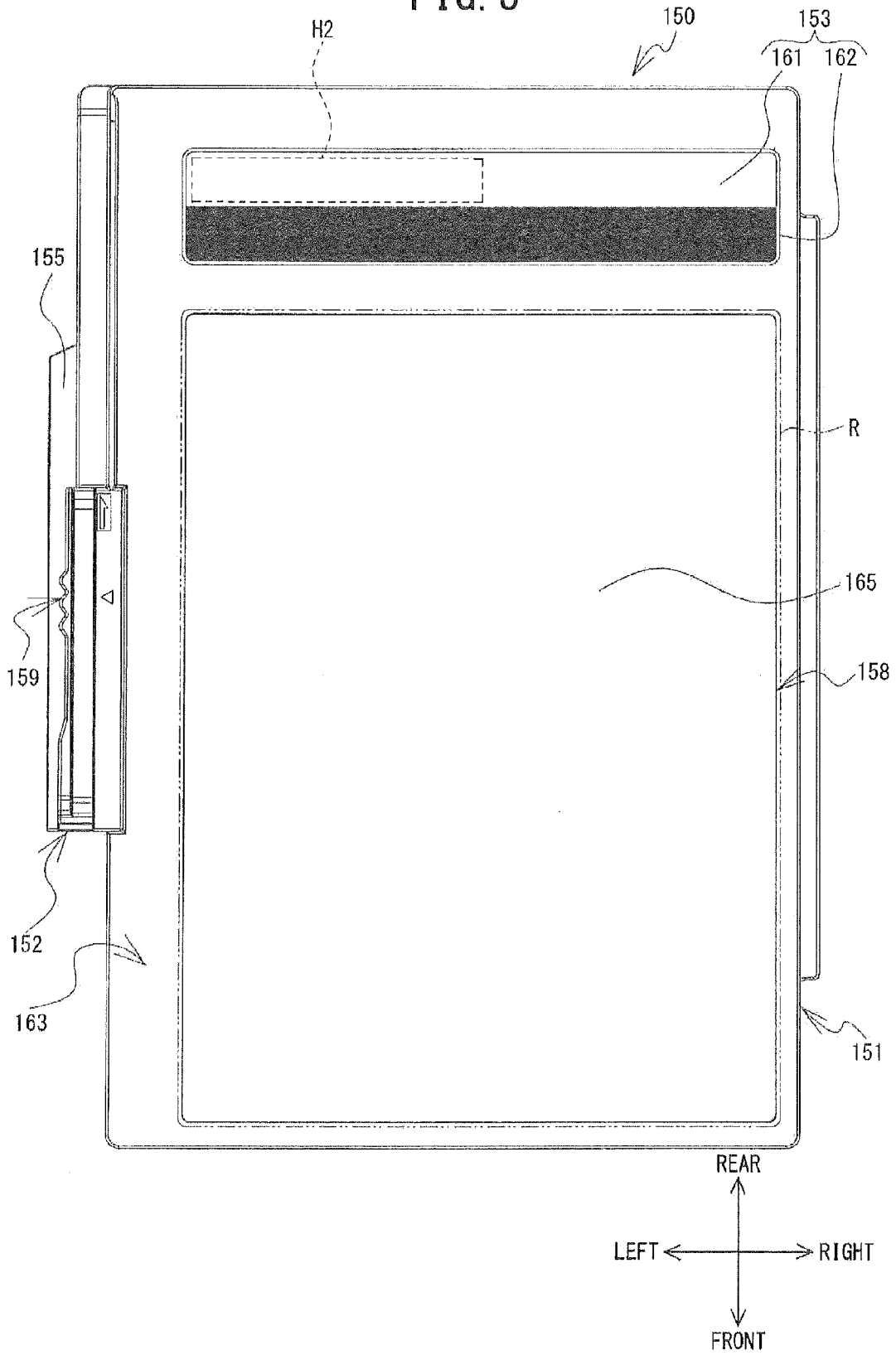
FIG. 3 is a plan view of a holder member.
Figure 4:
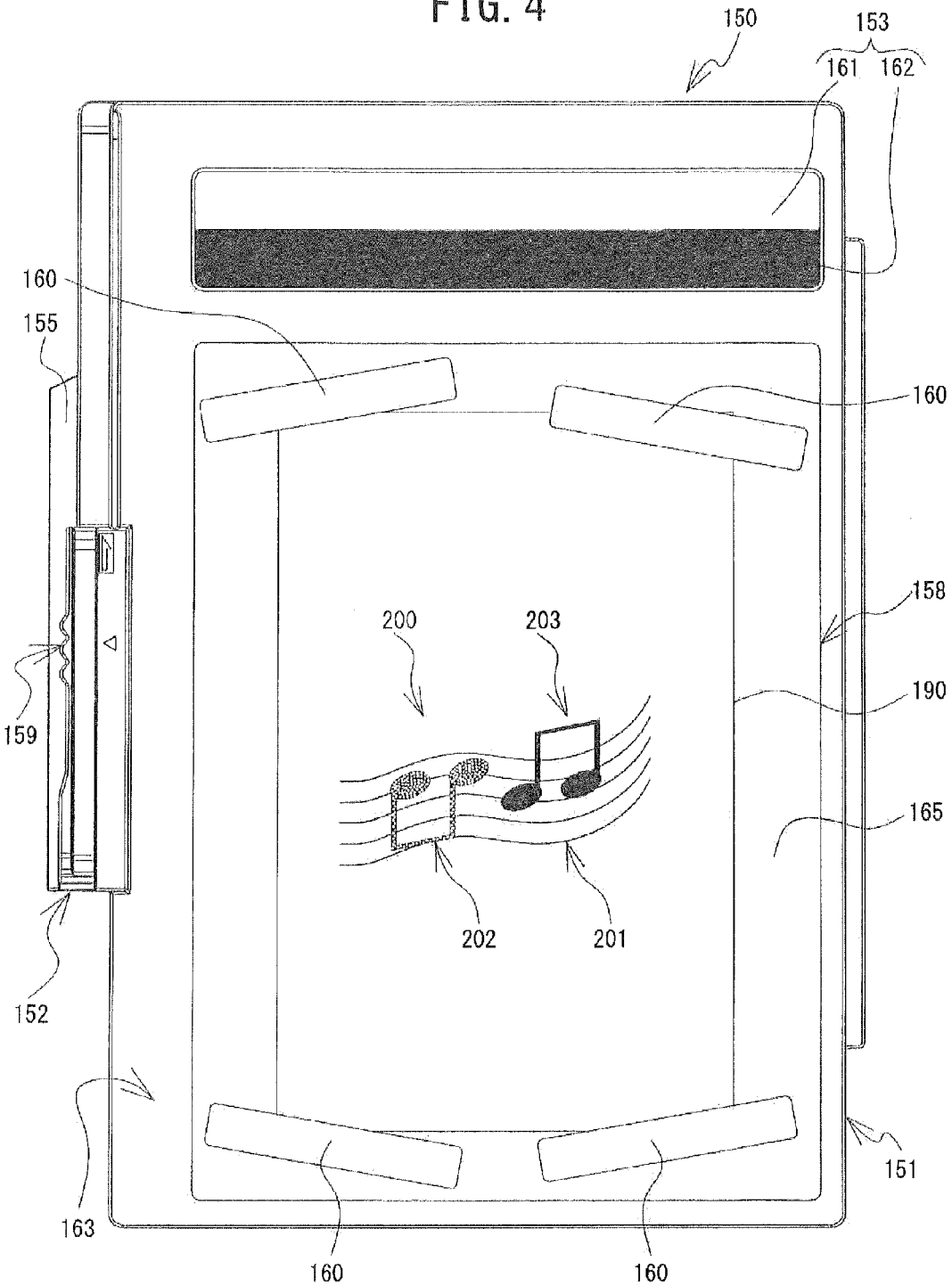
FIG. 4 is a plan view of the holder member in a state in which a paper is affixed to it.

As shown in FIGS. 3 and 4, the holder member 150 is mainly provided with a planar portion 151, the mounting portion 152, a protective plate 155, the color reference member 153, and four magnets 160 (refer to FIG. 4). The planar portion 151, the mounting portion 152, and the protective plate 155 are formed as a single unit from a resin material. The planar portion 151 has a surface 163 that is rectangular and planar in a plan view.

A drawing area 158 is an area within the surface 163 that is rectangular in a plan view and that includes a center portion of the surface 163. The drawing area 158 is formed by a plate 165 that is made of a magnetic material (for example, iron). The plate 165 has been given a surface treatment that makes it possible to do at least one of drawing with a writing instrument (for example, a special pen) and erasing with an erasing instrument. The plate 165 in the present embodiment is a whiteboard whose surface has been coated with a fluorine resin, for example. The user is able to perform drawing with a writing instrument and erasing with an erasing instrument in the drawing area 158.

The drawing area 158 is substantially congruent with the image capture object region R (refer to the dashed-two dotted lines in FIG. 3) that is set in a case where the holder member 150 is mounted on the moving mechanism 40. The image capture object region R is a rectangular range that is the object of image capture by the image sensor 35 (refer to FIG. 2). The sewing machine 1 in the present embodiment sets the image capture object region R that corresponds to the holder member 150 that has been mounted on the moving mechanism 40, based on data that are stored in the flash memory 64 (refer to FIG. 5). The image capture object region R is set within a maximum image capture range of the sewing machine 1 (that is, within the maximum range of the region where the sewing machine 1 is able to capture an image). The maximum image capture range of the sewing machine 1 is set in advance in accordance with the image capture enabled range H1 of the image sensor 35, the range of movement of the moving mechanism 40, the size of the holder member 150, and the like.

In order to create the image data for the images that are captured of the entire image capture object region R, the sewing machine 1 uses the image sensor 35 to capture images sequentially within the image capture object region R as the holder member 150 is moved by the moving mechanism 40. In other words, the sewing machine 1 uses the image sensor 35 to sequentially capture images of the object of the holder member 150 that moves in relation to the image sensor 35. By combining the plurality of partial images that have been captured by the image sensor 35, the sewing machine 1 is able to create a composite image that depicts the entire object of image capture.

A recessed portion (not shown in the drawings) with which the plate 165 engages is formed in the planar portion 151. The depth of the recessed portion is approximately equal to the thickness of the plate 165. The back face of the plate 165 adheres to the recessed portion of the planar portion 151, affixing the plate 165 to the planar portion 151. The mounting portion 152 is provided approximately in the center of one long side of the perimeter portion of the planar portion 151 (in the present embodiment, the left side of the planar portion 151) and is a rectangular component in a plan view whose long axis extends in the front-rear direction. The mounting portion 152 supports the planar portion 151 and is configured to be removably mounted on the moving mechanism 40. A detected portion 159 is provided on the mounting portion 152. The detected portion 159 has a shape that is particular to the type of the holder member 150. In a case where the holder member 150 has been mounted on the moving mechanism 40, the shape of the detected portion 159 is detected by a detector 36 (refer to FIG. 5), which will be described later. The sewing machine 1 is able to specify that the holder member 150 has been mounted, based on the shape of the detected portion 159 that has been detected.

A detected portion is also provided on the embroidery frame, although it is not shown in the drawings. The detected portion of the embroidery frame has a shape that is particular to the type of the embroidery frame and that is different from the shape of the detected portion 159. In a case where the embroidery frame has been mounted on the moving mechanism 40, the shape of the detected portion of the embroidery frame is detected by the detector 36. Based on the shape of the detected portion that has been detected, the sewing machine 1 is able to specify that the embroidery frame has been mounted and what the type of the embroidery frame is.

The protective plate 155 is a component that prevents the holder member 150 from being mounted by mistake on the moving mechanism of a non-compatible sewing machine. A non-compatible sewing machine is a sewing machine that is not provided with the image sensor 35. The protective plate 155 protrudes from the outer edge of the mounting portion 152, substantially parallel to the surface 163. Specifically, the protective plate 155 includes a portion that extends farther to the left than the left edge of the mounting portion 152 and a portion that extends farther to the rear than the rear edge of the mounting portion 152.

When the user mounts the holder member 150 on the moving mechanism 40, the user moves the mounting portion 152 of the holder member 150 toward the rear from a state in which the holder member 150 is disposed in front of the moving mechanism 40, inserting the mounting portion 152 into the frame holder of the moving mechanism 40. In a case where the user tries to mount the holder member 150 on the moving mechanism of a non-compatible sewing machine, for example, the protective plate 155 would interfere with the frame holder of the moving mechanism of the non-compatible sewing machine, and the mounting portion 152 could not be inserted into the frame holder.

In the sewing machine 1 in the present embodiment, the protective plate 155 is configured such that it does not interfere with the frame holder of the moving mechanism 40. Therefore, in a case where the user mounts the holder member 150 on the sewing machine 1, the user is able to insert the mounting portion 152 into the frame holder. In a case where the holder member 150 has been mounted on the moving mechanism 40, the surface 163 is disposed substantially parallel to the bed 11 (refer to FIG. 1). The planar portion 151 is disposed on the top side of the needle plate 21 and below the needle bar 6 and the presser foot 9 (refer to FIG. 2).

The color reference member 153 is a member that serves as a color reference. The color reference member 153 is located farther toward one end of the holder member 150 in the long side direction than is the drawing area 158 (in the present embodiment, to the rear of the drawing area 158). The color reference member 153 includes a white color reference member 161 and a black color reference member 162 that are provided in substantially the same plane as the surface 163. The white color reference member 161 is a member that serves as a reference for the color white. The black color reference member 162 is a member that serves as a reference for the color black. The color reference member 153 in the present embodiment is a planar reflective plate that is provided on the surface 163. In other words, the white color reference member 161 and the black color reference member 162 are white and black reflective plates, respectively. Note that the color reference member 153 may also be a component in which a white color and a black color have been printed on the surface 163, as well as a component in which the surface 163 has been coated with white and black paints. The color reference member 153 may also be white and black reflective tapes that have been affixed to the surface 163.

The white color reference member 161 and the black color reference member 162 are each provided within the maximum image capture range of the sewing machine 1 and have surface areas that are smaller than the image capture object region R. In the present embodiment, the white color reference member 161 and the black color reference member 162 are both identical rectangles that extend in the short side direction (in the present embodiment, the left-right direction) of the holder member 150. The white color reference member 161 and the black color reference member 162 are adjacent to one another in the long side direction (in the present embodiment, the front-rear direction) of the holder member 150. The lengths of the white color reference member 161 and the black color reference member 162 in the front-rear direction are set by taking the unit image capture range H2 into consideration. For example, the lengths of the white color reference member 161 and the black color reference member 162 in the front-rear direction are greater than the length of the reference size of the unit image capture range H2 in the auxiliary scanning direction.

Each of the four magnets 160 is a thin plate-shaped magnet that is rectangular in a plan view. The object of image capture (for example, a paper 190) can be disposed in the drawing area 158. The magnets 160 are disposed in the drawing area 158 from the top side of the object of image capture. The magnets 160 are able to affix the object of image capture to the drawing area 158 by sticking the object of image capture to the plate 165.

Figure 5:
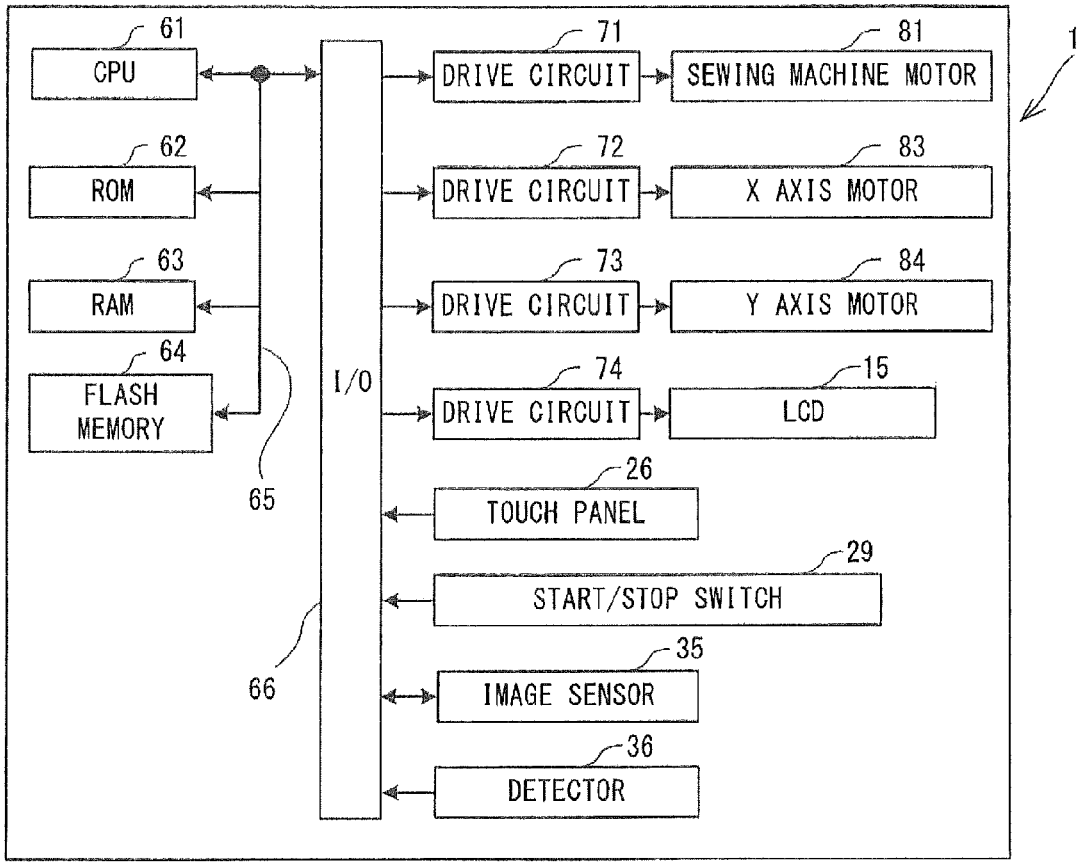
FIG. 5 is a block diagram that shows an electrical configuration of the sewing machine.

An electrical configuration of the sewing machine 1 will be explained with reference to FIG. 5. The sewing machine 1 is provided with the CPU 61, a ROM 62, the RAM 63, the flash memory 64, and an input/output interface (I/O interface) 66. The CPU 61 is connected to the ROM 62, the RAM 63, the flash memory 64, and the I/O interface 66 by a bus 65.

The CPU 61 performs main control of the sewing machine 1 and, in accordance with various types of programs that are stored in the ROM 62, performs various types of computations and processing that are related to image capture and sewing. The ROM 62 is provided with a plurality of storage areas that include a program storage area. Various types of programs for operating the sewing machine 1 (for example, a program for performing the main processing that will be described later) are stored in the program storage area.

The RAM 63 is provided with a storage areas that stores computation results and the like from computational processing by the CPU 61. Various types of parameters and the like for the sewing machine 1 to perform various types of processing are stored in the flash memory 64. Drive circuits 71 to 74, the touch panel 26, the start/stop switch 29, the image sensor 35, and the detector 36 are connected to the I/O interface 66. The detector 36 is configured to detect that one of the embroidery frame and the holder member 150 is mounted on the moving mechanism 40, and to output a detection result.

The sewing machine motor 81 is connected to the drive circuit 71. The drive circuit 71 drives the sewing machine motor 81 in accordance with a control signal from the CPU 61. As the sewing machine motor 81 is driven, the needle bar up-down drive mechanism 34 (refer to FIG. 2) is driven through the drive shaft (not shown in the drawings) of the sewing machine 1, and the needle bar 6 is moved up and down. The X axis motor 83 is connected to the drive circuit 72. The Y axis motor 84 is connected to the drive circuit 73. The drive circuits 72 and 73 respectively drive the X axis motor 83 and the Y axis motor 84 in accordance with control signals from the CPU 61. As the X axis motor 83 and the Y axis motor 84 are driven, the one of the embroidery frame and the holder member 150 that is mounted on the moving mechanism 40 is moved in the left-right direction (the X axis direction) and the front-rear direction (the Y axis direction) by amounts that correspond to the control signals. By driving the LCD 15 in accordance with a control signal from the CPU 61, the drive circuit 74 causes the LCD 15 to display an image.

The operation of the sewing machine 1 will be explained briefly. During embroidery sewing in which the embroidery frame (not shown in the drawings) is used, the needle bar up-down drive mechanism 34 (refer to FIG. 2) and the shuttle mechanism (not shown in the drawings) are driven in conjunction with the moving of the embroidery frame in the X axis direction and the Y axis direction by the moving mechanism 40. An embroidery pattern is thus sewn, by the sewing needle 7 that is mounted on the needle bar 6, in the sewing workpiece that is held in the embroidery frame. When an ordinary utility pattern that is not an embroidery pattern is sewn, the sewing is performed as the sewing workpiece is moved by the feed dog (not shown in the drawings), in a state in which the moving mechanism 40 has been removed from the bed 11.

The main processing of the sewing machine 1 will be explained with reference to FIG. 6. The image data that are created when an image of the color reference member 153 is captured will be called the first image data. The image data that are created when an image is captured of a figure that has been drawn on the object of image capture will be called the second image data. In the present embodiment, an image of the object of image capture is captured by the image sensor 35 in a state in which the object of image capture is held by the holder member 150. The colors in the second image data (specifically, partial image data that will be described later) are corrected based on the first image data. In the main processing, embroidery data are created based on the second image data.

In the main processing, a plurality of stitches (a pattern) that express the figure of which the image was captured are sewn in the sewing workpiece, based on the embroidery data that have been created. The embroidery data include a sewing order and coordinate data. The coordinate data describe the positions to which the embroidery frame is moved by the moving mechanism 40. The coordinate data in the present embodiment describe the coordinates (relative coordinates) in the embroidery coordinate system of needle drop points for sewing the pattern. The needle drop points are the points where the sewing needle 7, which is disposed directly above the needle hole (not shown in the drawings) in needle plate 21, pierces the sewing workpiece when the needle bar 6 is moved downward from above.

The embroidery data in the present embodiment include thread color data. The thread color data are data that indicate the colors of the upper threads that will form the stitches. In the main processing, the thread color data are determined based on color information for the figure that is described by the corrected second image data. In the explanation that follows, as an example, a case will be explained in which the embroidery data are created in order to describe a FIG. 200 that is drawn on the paper 190 that is shown in FIG. 4. The FIG. 200 is a figure in which a FIG. 201 of a musical staff in a first color, a FIG. 202 of musical notes in a second color, and a FIG. 203 of musical notes in a third color are combined.

The main processing is started in a case where the user has used a panel operation to input a start command. When the CPU 61 detects the start command, it reads into the RAM 63 the program for performing the main processing, which is stored in the program storage area of the ROM 62. In accordance with the instructions that are contained in the program that was read into the RAM 63, the CPU 61 executes the steps that will hereinafter be described. Various types of parameters that are necessary for performing the main processing are stored in the flash memory 64. Various types of data that are produced in the course of the main processing are stored in the RAM 63 as appropriate.

In order to simplify the explanation that follows, it is assumed that the holder member 150 has been mounted on the moving mechanism 40 prior to the start of the main processing. When the main processing starts, the CPU 61 defines the unit image capture range H2 of the reference size in the RAM 63. In the present embodiment, the length of the unit image capture range H2 of the reference size in the left-right direction is slightly more than half of the length of the image capture object region R in the left-right direction (refer to FIG. 3).

Figure 6:
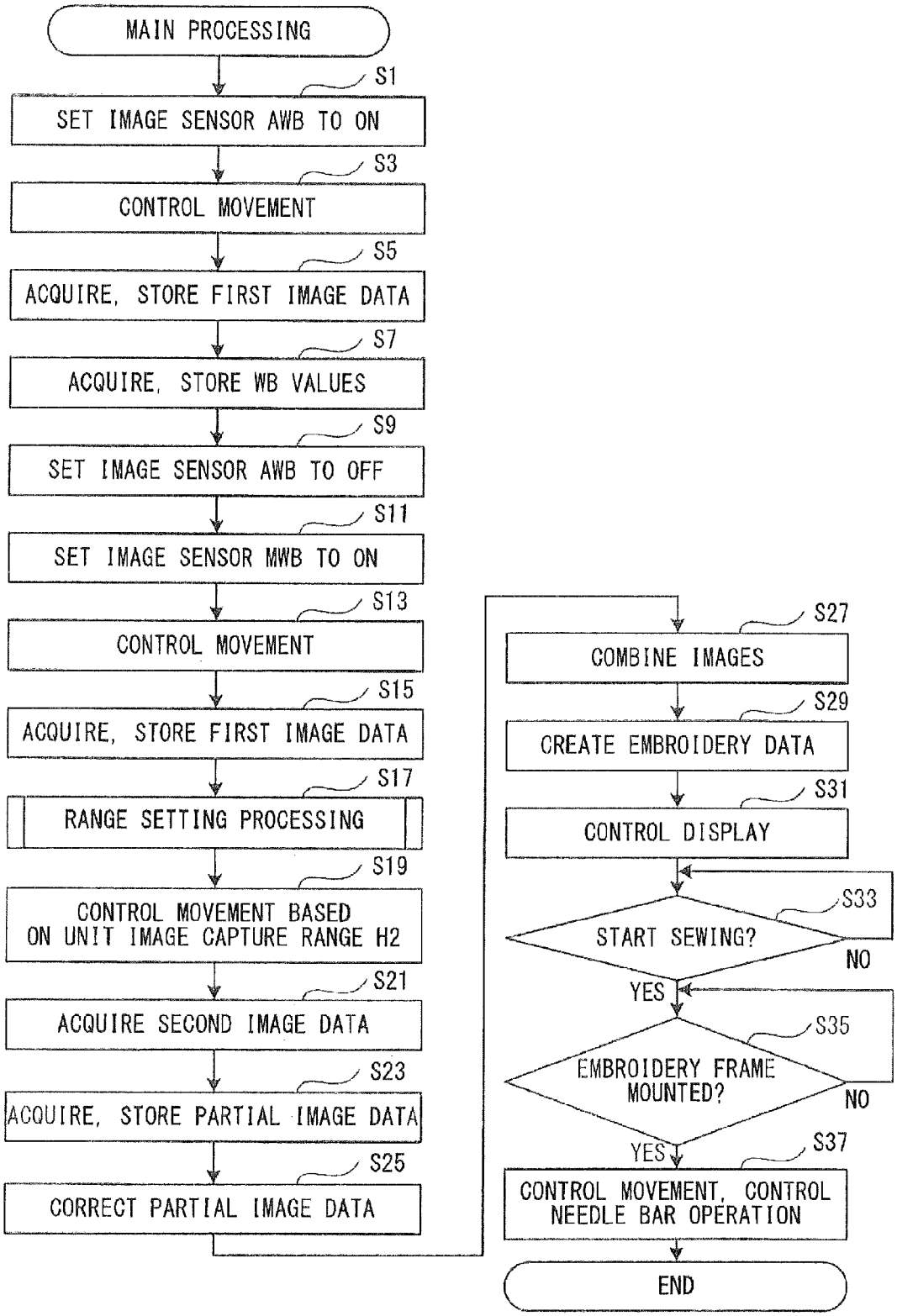
FIG. 6 is a flowchart of main processing.

In the main processing that is shown in FIG. 6, the CPU 61 sets the AWB of the image sensor 35 to on (Step S1). Based on first coordinate data that are stored in the flash memory 64, the CPU 61 controls the drive circuits 72, 73 to move the holder member 150 (Step S3). The first coordinate data are coordinate data that indicate a position where at least a part of the white color reference member 161 is in the unit image capture range H2 of the reference size. In this manner, at least a part of the white color reference member 161 is disposed inside the unit image capture range H2 of the reference size. Note that the first coordinate data may also be coordinate data that indicate a position that varies according to the type of the holder member. In that case, it is sufficient for the CPU 61 to acquire the most appropriate first coordinate data from the flash memory 64 in accordance with the type of the holder member that was detected by the detector 36.

Figure 7:
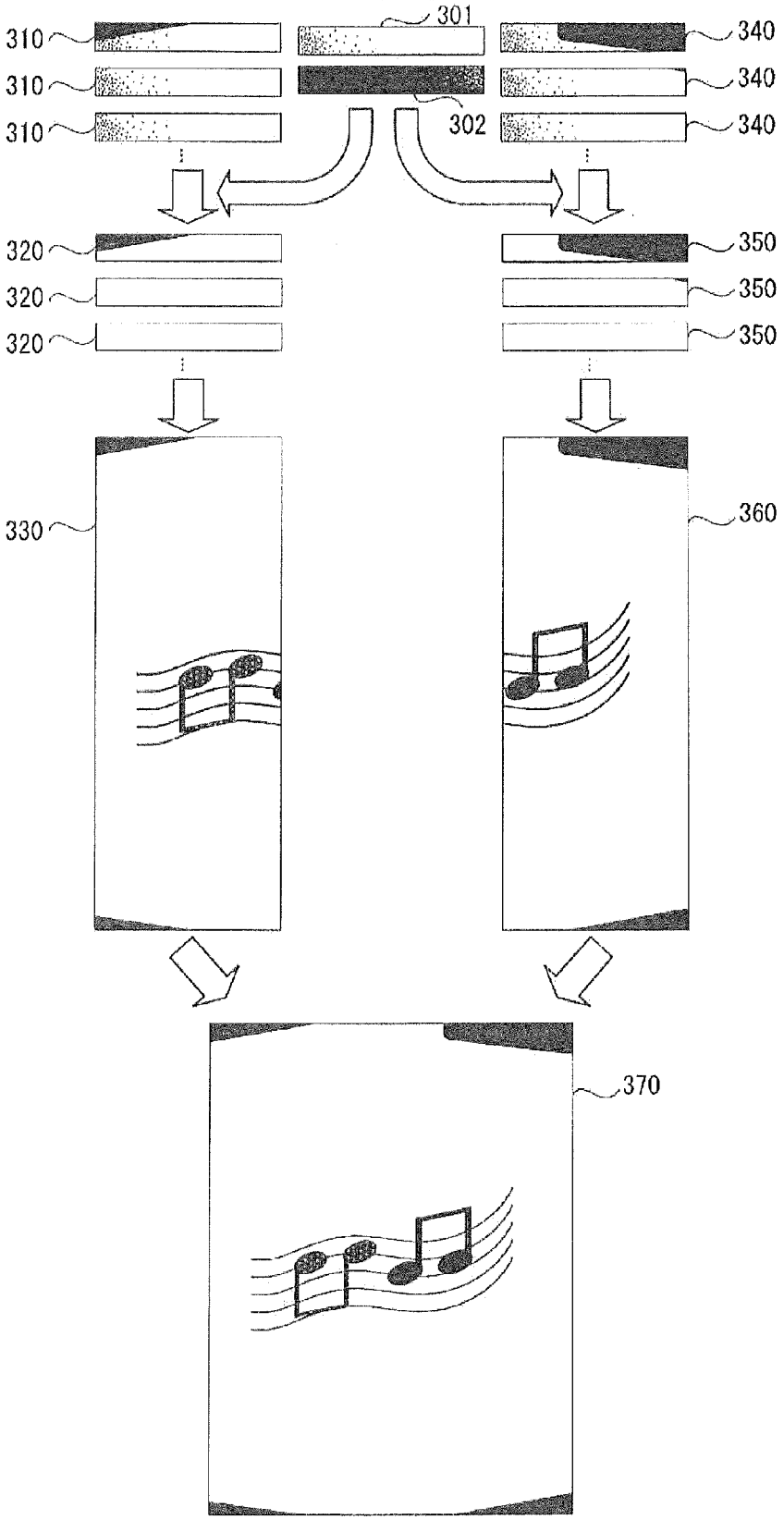
FIG. 7 is an explanatory figure that schematically shows a process in which composite image data are created.

The CPU 61 acquires the first image data from the image sensor 35 and stores the acquired first image data as white color reference image data in the RAM 63 (Step S5). More specifically, the image sensor 35 determines the determined WB values by a known method, based on the color information in the image data for the captured image of the white color reference member 161. Using the determined WB values it has determined, the image sensor 35 corrects the image data for the captured image. From among the corrected image data, the CPU 61 acquires, as the first image data, data that describe an image that corresponds to the unit image capture range 112 of the reference size. A white color reference image 301, an example of which is shown in FIG. 7, is an image that is described by the white color reference image data that were acquired at Step S5. In other words, among the images that have been captured by the image sensor 35, the white color reference image 301 is an image that shows the part of the white color reference member 161 for which the image was captured in the unit image capture range H2 of the reference size.

The CPU 61 acquires the determined WB values that have been output by the image sensor 35 and stores them in the RAM 63 (Step S7). The CPU 61 sets the AWB of the image sensor 35 to off (Step S9). The CPU 61 sets the MWB of the image sensor 35 to on, with the determined WB values that were acquired at Step S7 defined as the set WB values (Step S11).

Based on second coordinate data that are stored in the flash memory 64, the CPU 61 controls the drive circuits 72, 73 to move the holder member 150 (Step S13). The second coordinate data are coordinate data that indicate a position where at least a part of the black color reference member 162 is in the unit image capture range H2 of the reference size. In this manner, at least a part of the black color reference member 162 is disposed inside the unit image capture range H2 of the reference size. Note that the second coordinate data may also be coordinate data that indicate a position that varies according to the type of the holder member. In that case, it is sufficient for the CPU 61 to acquire the most appropriate second coordinate data from the flash memory 64 in accordance with the type of the holder member that was detected by the detector 36.

The CPU 61 acquires the first image data from the image sensor 35 and stores the acquired first image data as black color reference image data in the RAM 63 (Step S15). More specifically, using the set WB values that were set at Step S11, the image sensor 35 corrects the image data for the captured image of the black color reference member 162. From among the corrected image data, the CPU 61 acquires, as the first image data, data that describe an image that corresponds to the unit image capture range H2 of the reference size. A black color reference image 302, an example of which is shown in FIG. 7, is an image that is described by the black color reference image data that were acquired at Step S15. In other words, among the images that have been captured by the image sensor 35, the black color reference image 302 is an image that shows the part of the black color reference member 162 for which the image was captured in the unit image capture range 112 of the reference size. After Step S15 has been executed, range setting processing that is hereinafter described is performed (Step S17).

Figure 8:
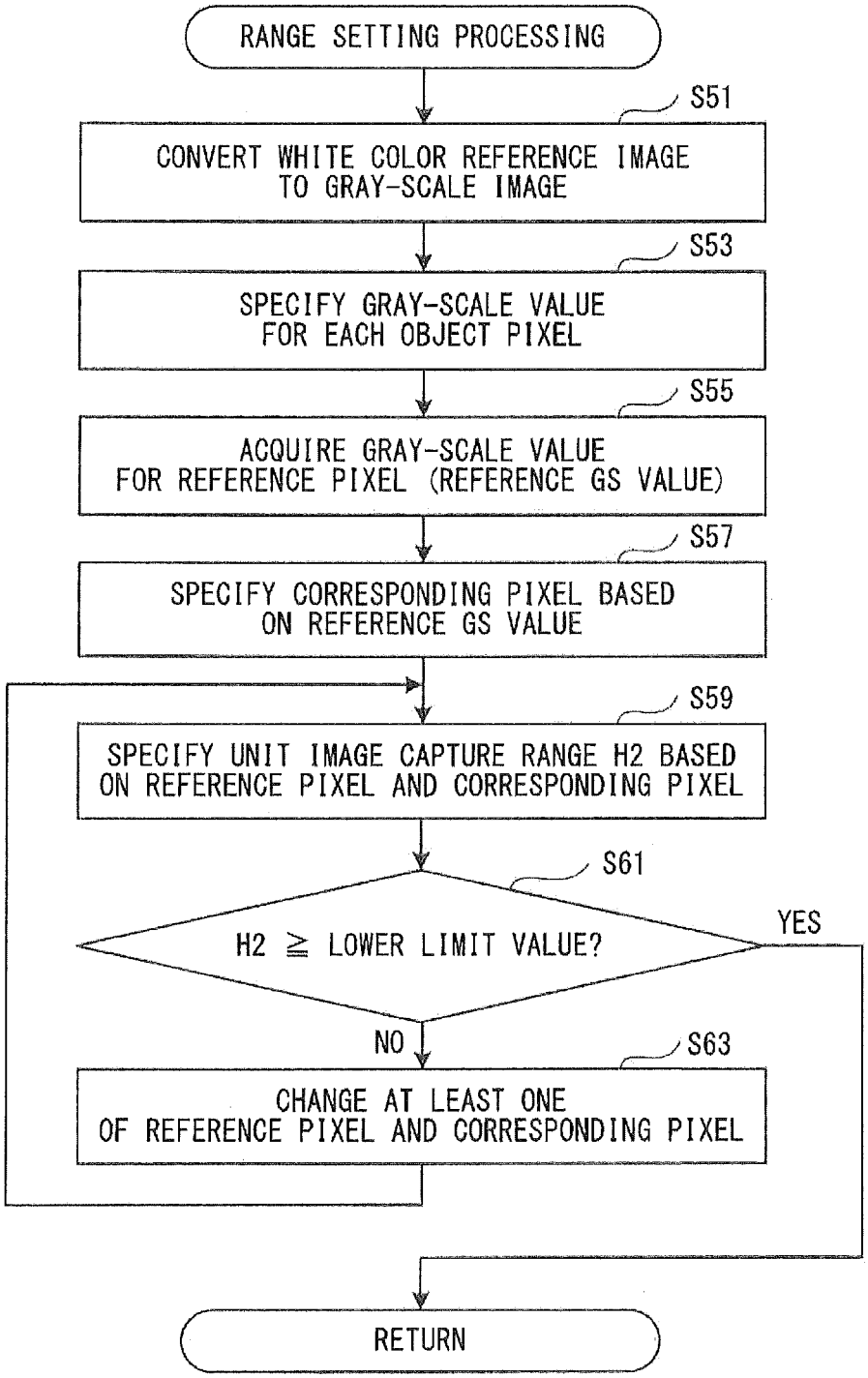
FIG. 8 is a flowchart of range setting processing.

In the range setting processing that is shown in FIG. 8, the CPU 61 takes the white color reference image that is described by the white color reference image data that were acquired at Step S5 and converts it to a gray-scale image by a known method (Step S51). In this manner, the plurality of pixels that make up the white color reference image are each converted to pixels that have corresponding gray-scale values.

Based on the converted gray-scale image, the CPU 61 specifies a gray-scale value for each one of a plurality of object pixels (Step S53). Among the plurality of pixels that make up the gray-scale image, the plurality of the object pixels are the plurality of the pixels that are arrayed in the main scanning direction. In the present embodiment, the plurality of pixels in the gray-scale image that are in a specified position in the auxiliary scanning direction (for example, the plurality of pixels that are in the center of the front-rear direction of the gray-scale image) are used as the plurality of the object pixels.

Figure 9:
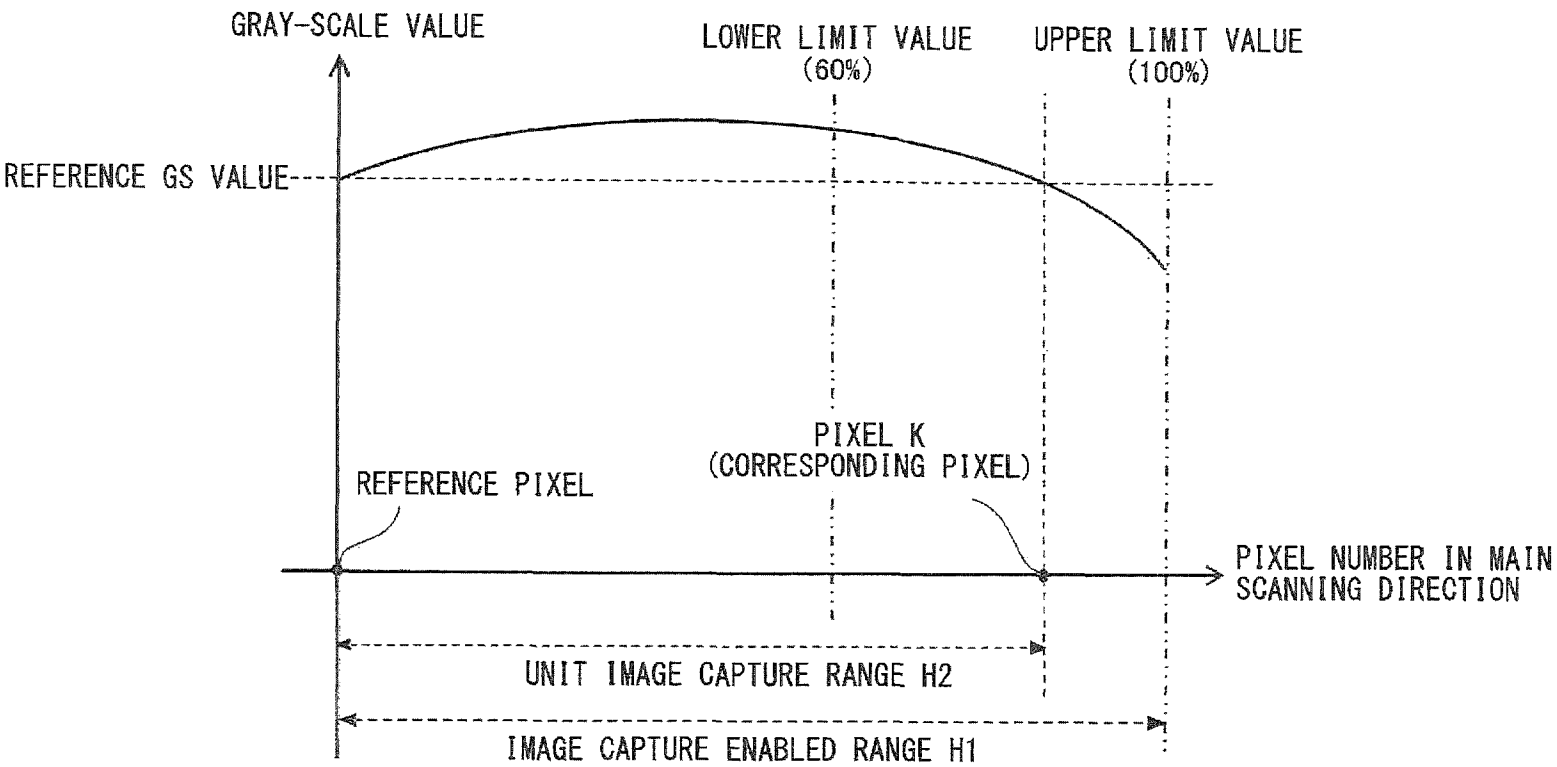
FIG. 9 is a graph that shows a relationship between a gray-scale value and a pixel number in a main scanning direction.

The graph that is shown as an example in FIG. 9 shows variations in the gray-scale values that were specified at Step S53 for the plurality of the object pixels, with the horizontal axis indicating pixel numbers that have been assigned along the main scanning direction (the left-right direction) and the vertical axis indicating the gray-scale values. In the present embodiment, the gray-scale value that corresponds to each one of the plurality of the object pixels is a gray-scale value that corresponds to one pixel number (that is, one point on the horizontal axis that is shown in FIG. 9). As an example, the graph in FIG. 9 shows variations in the gray-scale values of the plurality of pixels that are arrayed in the main scanning direction, at the center of the auxiliary scanning direction of the gray-scale image. The variations in the gray-scale values are due to factors in the environment in which the sewing machine 1 is used (for example, differences in the brightness of the surroundings, differences in light sources, or the like).

As shown in FIG. 8, the CPU 61, based on the gray-scale values that were specified at Step S53 for the plurality of the object pixels, acquires the gray-scale value of a reference pixel (hereinafter called the reference GS value) (Step S55). The reference pixel is a pixel, among the plurality of the object pixels, that serves as a reference for modifying the unit image capture range H2. In the present embodiment, the pixel with the smallest pixel number in the main scanning direction (that is, the object pixel at the left end) is acquired as the reference pixel. Accordingly, in the example that is shown in FIG. 9, the pixel at the zero position on the horizontal axis is the reference pixel, and the gray-scale value that corresponds to the reference pixel is acquired as the reference GS value. Note that in FIG. 9, the reference pixel may also be a pixel that is at a position other than the zero position on the horizontal axis.

The CPU 61 specifies a corresponding pixel, based on the reference GS value that was acquired at Step S55 (Step S57). The corresponding pixel is a pixel, among the plurality of the object pixels, that has a gray-scale value that is either equal to the reference GS value or that differs from the reference GS value by no more than a specified threshold value. Accordingly, in the example that is shown in FIG. 9, a pixel K that has a gray-scale value that is equal to the reference GS value is specified as the corresponding pixel.

Note that in a case where there is no pixel that has a gray-scale value that is equal to the reference GS value, the CPU 61 specifies, as the corresponding pixel, a pixel that has a gray-scale value that differs from the reference GS value by no more than a specified threshold value (for example, ±10%). In a case where there are a plurality of pixels that have gray-scale values that differ from the reference GS value by no more than the specified threshold value, it is preferable for the CPU 61 to specify, as the corresponding pixel, the one of those pixels that has the largest pixel number in the main scanning direction (that is, the pixel that is most distant from the reference pixel).

As shown in FIG. 8, the CPU 61 specifies the unit image capture range H2 based on the reference pixel and the corresponding pixel (Step S59). Specifically, the CPU 61 specifies the range from the reference pixel to the corresponding pixel as the range of the unit image capture range H2 in the main scanning direction. Note that in the present embodiment, the range in the auxiliary scanning direction of the unit image capture range H2 that was specified at Step S59 is equal to the range of the unit image capture range H2 of the reference size in the auxiliary scanning direction (for example, 600 dots).

The unit image capture range H2 that is specified at Step S59 is a range in which images are captured by a first image capture element, a second image capture element, and a third image capture element, among the plurality of the image capture elements 35A that the image sensor 35 has. The first image capture element is the image capture element 35A that corresponds to the reference pixel (that is, the image capture element 35A that performs image capture for the reference pixel). The second image capture element is the image capture element 35A that corresponds to the corresponding pixel (that is, the image capture element 35A that performs image capture for the corresponding pixel). The third image capture element is at least one of the image capture elements 35A that are disposed between the first image capture element and the second image capture element. In other words the third image capture element is one of the image capture elements 35A that captures an image for at least one pixel that is arrayed in the main scanning direction between the reference pixel and the corresponding pixel.

The CPU 61 determines whether the unit image capture range H2 that was specified at Step S59 is not less than a lower limit value (Step S61). The lower limit value is a threshold value for keeping the unit image capture range H2 from becoming too small. For example, the lower limit value is 60% of an upper limit value. The upper limit value is the main scanning direction length of the image capture enabled range H1. In the example that is shown in FIG. 9, the unit image capture range H2 is between the lower limit value and the upper limit value. Therefore, the CPU 61 determines that the unit image capture range H2 is not less than the lower limit value (YES at Step S61) and returns the processing to the main processing. In this case, in the example that is shown in FIG. 9, the unit image capture range H2 is specified to be 800 dots by 600 dots.

Figure 10:
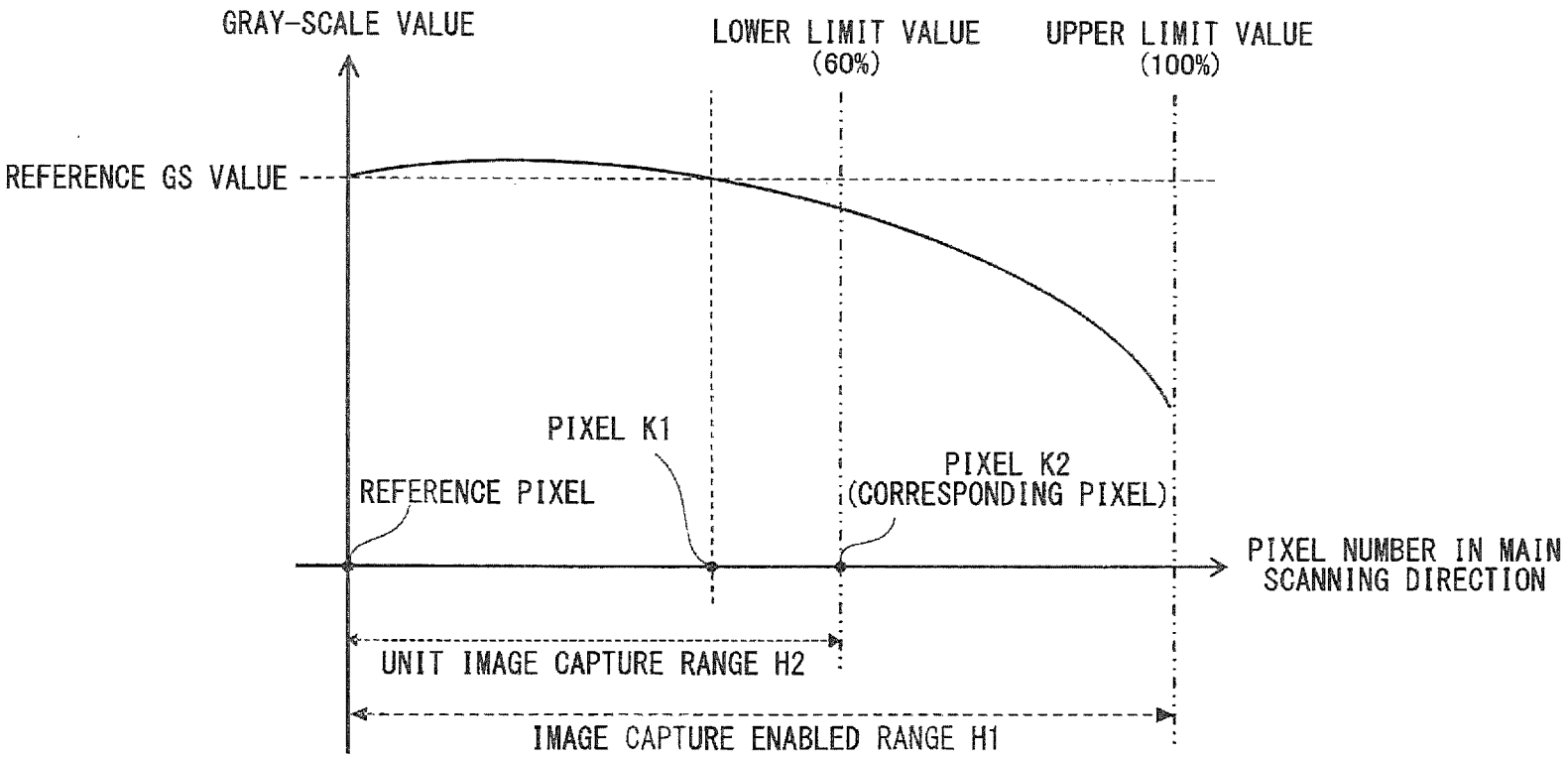
FIG. 10 is a graph that shows relationships between gray-scale values and pixel numbers in the main scanning direction.

On the other hand, in the example that is shown in FIG. 10, the pixel that has the same gray-scale value as the reference pixel is a pixel K1. In a case where the pixel K1 has been specified as the corresponding pixel, the unit image capture range H2 is less than the lower limit value (NO at Step S61). In this case, as shown in FIG. 8, the CPU 61 changes at least one of the reference pixel and the corresponding pixel such that the main scanning direction distance between the reference pixel and the corresponding pixel will be not less than the lower limit value (Step S63). For example, as shown in FIG. 10, the CPU 61 may change the corresponding pixel to a pixel K2, which has a larger pixel number than does the pixel K1. The main scanning direction distance from the reference pixel to the pixel K2 is equal to the lower limit value.

After executing Step S63, the CPU 61 once again specifies the unit image capture range H2 based on the reference pixel and the corresponding pixel (Step S59). In the example that is shown in FIG. 10, the corresponding pixel has been changed from the pixel K1 to the pixel K2, so the unit image capture range H2 is equal to the lower limit value. Therefore, the CPU 61 determines that the unit image capture range H2 is not less than the lower limit value (YES at Step S61) and returns the processing to the main processing. In this case, in the example that is shown in FIG. 10, the unit image capture range H2 is specified to be 600 dots by 600 dots.

As shown in FIG. 6, based on third coordinate data that are stored in the flash memory 64 and on the unit image capture range H2 that was specified at Step S17, the CPU 61 controls the drive circuits 72, 73 to move the holder member 150 (Step S19). The third coordinate data are coordinate data that indicate a position where at least a part of the image capture object region R is in the unit image capture range H2 that was specified at Step S17. In this manner, at least a part of the object of image capture (in the present embodiment, the paper 190) in the drawing area 158 is disposed inside the unit image capture range H2 that was specified at Step S17. Note that the third coordinate data may also be coordinate data that indicate a position that varies according to the type of the holder member. In that case, it is sufficient for the CPU 61 to acquire the most appropriate third coordinate data from the flash memory 64 in accordance with the type of the holder member that was detected by the detector 36.

In the present embodiment, because the unit image capture range H2 is smaller than the image capture object region R, the CPU 61 moves the holder member 150 reciprocally in the front-rear direction (the auxiliary scanning direction) as it shifts the holder member 150 in the left-right direction (the main scanning direction). For example, after the CPU 61 has finished moving the holder member 150 in the forward direction, it moves the holder member 150 to the right by a specified amount, and then starts moving the holder member 150 in the rearward direction.

Accordingly, when the CPU 61 executes Step S19, it corrects the third coordinate data based on the unit image capture range H2 that was specified at Step S17. For example, during a single round of reciprocal movement of the holder member 150 in the front-rear direction, the image sensor 35 is able to acquire a plurality of forward movement images and a plurality of rearward movement images. The plurality of the forward movement images are a plurality of images of the unit image capture range H2 that are captured during the forward movement of the holder member 150. The plurality of the rearward movement images are a plurality of images of the unit image capture range H2 that are captured during the rearward movement of the holder member 150. The CPU 61 corrects the third coordinate data such that gaps and overlaps that occur between adjacent forward movement images will be less than a specified threshold value (for example, 5 dots). In the same manner, the CPU 61 corrects the third coordinate data such that gaps and overlaps that occur between adjacent rearward movement images will be less than the specified threshold value. The CPU 61 also corrects the third coordinate data such that gaps and overlaps that occur between adjacent forward movement images and rearward movement images will be less than the specified threshold value. Thus, based on the unit image capture range H2 that was specified at Step S17, the CPU 61 is able to control the movement of the holder member 150 by the moving mechanism 40 such that gaps and overlaps that occur between the plurality of the partial images, which will be described later, will be less than the specified threshold value.

The CPU 61 acquires a plurality of sets of the second image data by causing the image sensor 35 to capture a series of images of the image capture object region R in synchronization with the control of the drive circuits 72, 73 (Step S21). More specifically, at Step S21, the image sensor 35 performs image capture for the entire image capture object region R by capturing a plurality of partial images of the image capture object region R, using the image capture enabled range H1 as the unit of image capture for one round. The image sensor 35 also uses the set WB values that were set at Step S11 to correct the plurality of the sets of the second image data that have been captured. The CPU 61 acquires the plurality of the sets of the corrected second image data from the image sensor 35.

The CPU 61 acquires the partial image data from each one of the plurality of the sets of the corrected second image data and stores the partial image data in the RAM 63 (Step S23). More specifically, the CPU 61 acquires, from among the plurality of the sets of the corrected second image data, as a plurality of sets of the partial image data, data that describe an image that corresponds to the unit image capture range H2 that was specified at Step S17. The processing at Step S23 creates a plurality of sets of the partial image data that describe pluralities of partial images 310, 340, as shown in the example in FIG. 7. The plurality of partial images 310 are a plurality of images of the left half of the image capture object region R that were captured for a plurality of portions along the auxiliary scanning direction. The plurality of partial images 340 are a plurality of images of the right half of the image capture object region R that were captured for a plurality of portions along the auxiliary scanning direction.

Based on the white color reference image data and the black color reference image data, the CPU 61 corrects the plurality of the sets of the partial image data that were stored at Step S23 (Step S25). In the present embodiment, the CPU 61 performs known shading correction on the partial image data, based on the white color reference image data and the black color reference image data. More specifically, the portion of the white color reference image data that was acquired at Step S5 that corresponds to the unit image capture range H2 that was specified at Step S17 is used for the shading correction that is hereinafter described. In the same manner, the portion of the black color reference image data that was acquired at Step S15 that corresponds to the unit image capture range H2 that was specified at Step S17 is used for the shading correction that is hereinafter described. In the example that is shown in FIG. 7, the plurality of the sets of the partial image data that respectively correspond to the pluralities of partial images 310, 340 are individually corrected.

The procedure for the shading correction will be explained briefly using a specific example. Based on the white color reference image data, the R, G, B gradation values for N rows and M columns of pixels (N and M being positive integers) are acquired from among the plurality of pixels in matrix form that make up the white color reference image. In the same manner, based on the black color reference image data, the R, G, B gradation values for N rows and M columns of pixels are acquired from among the plurality of pixels in matrix form that make up the black color reference image. Based on the partial image data, the R, G, B gradation values for N rows and M columns of pixels are acquired from among the plurality of pixels in matrix form that make up the partial images. In a case where, in the N rows and M columns of pixels, the gradation values for the white color reference image data are defined as W, the gradation values for the black color reference image data are defined as B, and the gradation values for the partial image data are defined as S, corrected data D are produced by the equation below.

$$\text{Corrected data } D=(S-B)\times 255/(W-B)$$

In a case where the gradation values W are (240, 232, 238), the gradation values B are (10, 5, 9), and the gradation values S are (54, 152, 43), the CPU 61 calculates the corrected data D for each one of the (R, G, B) as shown below.

$$R=(54-10)\times 255/(240-10)=49$$

$$G=(152-5)\times 255/(232-5)=165$$

$$B=(43-9)\times 255/(238-9)=38$$

The CPU 61 performs the calculations above for all of the pixels that are contained in each image. As shown in the example in FIG. 7, the processing at Step S25 corrects a plurality of sets of the partial image data that correspond to each one of the plurality of partial images 310 and the plurality of the sets of the partial image data that correspond to each one of the plurality of partial images 340, based on the white color reference image data that describe the white color reference image 301 and the black color reference image data that describe the black color reference image 302. A plurality of partial images 320 and a plurality of partial images 350, examples of which as shown in FIG. 7, are images that are described by the respective pluralities of sets of corrected partial image data.

The processing at Step S25 corrects the plurality of the sets of the partial image data, based on the first image data (the white color reference image data and the black color reference image data), which were obtained by capturing images under the same image capture conditions (for example, brightness and light source) under which the second image data were captured. In other words, the white color reference image and the black color reference image are used to correct the colors of the plurality of the partial images, such that the influence of the actual use environment of the sewing machine 1 is limited. The sewing machine 1 is therefore able to acquire a plurality of partial images in which the appropriate colors are expressed, such that the coloring of the images is natural.

Furthermore, at Step S25, the portions of the white color reference image data and the black color reference image data that correspond to the unit image capture range H2 that was specified at Step S17 are used for the shading correction of the plurality of the sets of partial image data. Both edge portions in the main scanning direction of the unit image capture range H2 that was specified at Step S17 correspond to gray-scale values that are one of the same and approximately the same as one another. In other words, both edge portions of the gray-scale image for the first image data correspond to gray-scale values that are one of the same and approximately the same as one another. Therefore, the sewing machine 1 is able to perform the color correction for both edge portions in the main scanning direction of each one of the partial images at almost the same level that was used for the shading correction that is described above.

Based on the plurality of the sets of the partial image data that were corrected at Step S25, the CPU 61 creates composite image data that describe the entire image capture object region R (Step S27). The composite image data are image data that describe a single composite image that combines the plurality of the partial images that are described by the plurality of the sets of the partial image data. The composite image data are created by the procedure hereinafter described, for example. Based on a plurality of sets of the partial image data that correspond to the plurality of the partial images 320, the CPU 61 creates image data that describe an image 330 of the left half of the image capture object region R, as shown in FIG. 7. In the same manner, based on a plurality of sets of the partial image data that correspond to the plurality of the partial images 350, the CPU 61 creates image data that describe an image 360 of the right half of the image capture object region R. Based on the image data that describe the image 330 and the image data that describe the image 360, the CPU 61 creates the composite image data that describe a composite image 370 of the entire image capture object region R.

The CPU 61 creates the embroidery data based on the composite image data that were created at Step S27 (Step S29). A known method (for example, the method that is described in Japanese Laid-Open Patent Publication No. 2009-201704) may be used for the method that creates the embroidery data based on the image data. The embroidery data that are created by the processing at Step S29 include the sewing order, the coordinate data, and the thread color data. The thread color data describe thread colors that are set from among color information on the usable thread colors that is stored in a storage device (for example, the flash memory 64) of the sewing machine 1, the thread colors that are set being those that most closely resemble the color information for the figure that the composite image data describe. In the example that is shown in FIG. 4, the thread colors that are set are those that most closely resemble the first color, the second color, and the third color of the respective FIGS. 201 to 203 that are included in the FIG. 200, and the thread color data are created for those colors.

The image that the composite image data describe will be called the composite image. In some cases, unintended objects (for example, the magnets 160) are visible in the composite image. In those cases, the user may input a command that specifies the unintended objects within the composite image. At Step S29, the CPU 61 may perform the creating of the embroidery data by excluding the objects that have been specified by the user within the composite image.

The CPU 61 controls the drive circuit 74 to display on the LCD 15 a display screen that is not shown in the drawings (Step S31). For example, the composite image that is described by the composite image data that were created at Step S27, as well as information that is related to the pattern that is described by the embroidery data that were created at Step S29, may be displayed on the display screen. After checking the display screen, the user mounts on the moving mechanism 40 the embroidery frame (not shown in the drawings) that holds the sewing workpiece. The user inputs the command to start the sewing by performing a panel operation or pressing the start/stop switch 29, The CPU 61 waits until it detects the command to start the sewing (NO at Step S33). In a case where the CPU 61 has detected the command to start the sewing (YES at Step S33), it waits until it detects that the embroidery frame has been mounted, based on the detection result from the detector 36 (NO at Step S35). In a case where the CPU 61 has detected that the embroidery frame has been mounted (YES at Step S35), it controls the drive circuits 72, 73 in accordance with the embroidery data to drive the moving mechanism 40 and move the embroidery frame (Step S37). The CPU 61 synchronizes the drive control of the drive circuits 72, 73 and operates the drive circuit 71 to drive the needle bar up-down drive mechanism 34 (Step S37). In this manner, the plurality of the stitches that express the pattern of the composite image are formed in the sewing workpiece that is held by the embroidery frame, in accordance with the embroidery data.

Figure 11:
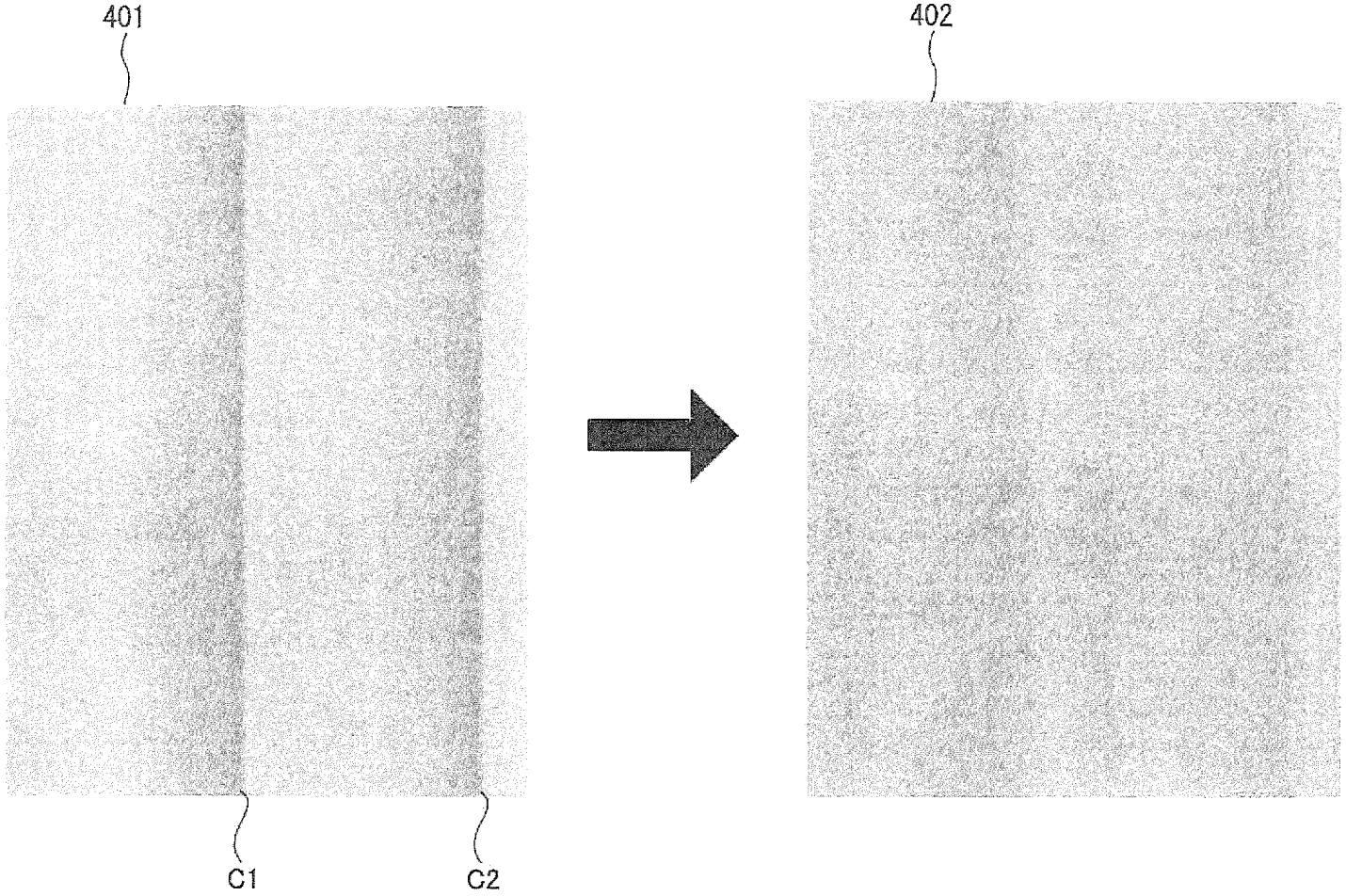
FIG. 11 is a figure that shows a specific example of a composite image.

Specific examples of composite images that are created by sewing machines will be explained with reference to FIG. 11. A composite image 401 is an image that combines a plurality of partial images that were captured by a known sewing machine by dividing an object into parts. A composite image 402 is an image that combines a plurality of partial images that were captured by the sewing machine 1 of the present embodiment by dividing an object into parts. The composite images 401, 402 both combine pluralities of partial images that were captured of the same object. In the composite image 401, differences C1, C2 in the shading of the colors occur at the boundaries between the combined partial images that extend in the main scanning direction (the left-right direction). In contrast, in the composite image 402, there are almost no differences in the shading of the colors at the boundaries between the combined partial images that extend in the main scanning direction (the left-right direction). The reason for this is that the shadings of the colors have been corrected by the various processing steps that the CPU 61 has executed, as described previously, such that the shadings are at almost the same level along both edge portions in the main scanning direction of each one of the partial images.

As explained above, according to the sewing machine 1 in the present embodiment, the unit image capture range H2 is set within the image capture enabled range H1, based on the white color reference image that the image sensor 35 captured of the white color reference member 161 (Step S17). The plurality of the partial images that were captured in the set unit image capture range 112 are acquired (Step S23). The composite image is created by combining the acquired plurality of the partial images (Step S27). That is, the unit image capture range H2 is set in order to suppress the differences in the shading of the colors that occur at the boundaries between the partial images that will be combined. The partial images that were captured in the unit image capture range H2 are acquired, and the composite image is created. Accordingly, the sewing machine 1 may acquire the composite image while suppressing the occurrence of differences in the shading of the colors at the boundaries between the partial images. Note that at Step S23, each one of the plurality of the partial images may also be acquired from a plurality of the second images that the image sensor 35 has captured in a plurality of regions that are included in the object of image capture.

The unit image capture range H2 is set based on pixel information (the gray-scale value) for each one of the plurality of pixels that make up the white color reference image (Step S17). Therefore, the sewing machine 1 may set a more appropriate range for the unit image capture range H2.

The image sensor 35 has the plurality of the image capture elements 35A that are arrayed in the main scanning direction and is configured to capture the second images along the auxiliary scanning direction. The white color reference image is converted to a gray-scale image (Step S51). In the converted gray-scale image, the gray-scale values are specified for each one of the plurality of the object pixels, which are the plurality of the pixels that are arrayed in the main scanning direction (Step S53). Based on the converted gray-scale image, the reference pixel, which has a gray-scale value that is equal to the reference GS value, and the corresponding pixel, which has a gray-scale value that is either equal to the reference GS value or that differs from the reference GS value by no more than the specified threshold value, are specified from among the plurality of the object pixels (Steps S55, S57). The unit image capture range H2 is a range in which images are captured by the first image capture element and the second image capture element, which respectively correspond to the reference pixel and the corresponding pixel, and by the at least one third image capture element, which is disposed between the first image capture element and the second image capture element. The first image capture element, the second image capture element, and the third image capture element are each among the plurality of the image capture elements 35A. Therefore, color correction of almost the same level may be performed for both edge portions in the main scanning direction in each of the partial images that were captured in the unit image capture range H2. The sewing machine 1 may suppress the occurrence of differences in the shading of the colors along the main scanning direction boundaries between the partial images.

In a case where the distance between the specified reference pixel and the specified corresponding pixel is less than the lower limit value, the corresponding pixel is changed to another one of the plurality of the object pixels, such that the distance between the reference pixel and the corresponding pixel will be not less than the lower limit value (Step S63). Therefore, the sewing machine 1 may keep the unit image capture range H2 from becoming too small.

The sewing needle 7 is mounted on the lower end of the needle bar 6. The holder member 150 has the drawing area 158. The drawing area 158 is disposed below the needle bar 6 and is configured to hold the object of image capture (for example, the paper 190). Therefore, the sewing machine 1 may capture an image of the object of image capture in the same position as the component that performs the sewing on the work cloth. The color reference member 153 is provided as a single unit with the holder member 150. Therefore, it is not necessary for the sewing machine 1 to be provided with the color reference member 153 separately from the holder member 150.

The moving mechanism 40 is configured to move the holder member 150. The CPU 61 uses the moving mechanism 40 to control the movement of the holder member 150. The image sensor 35 captures the plurality of the second images of the object of image capture, which moves in relation to the image sensor 35 in conjunction with the movement of the holder member 150. Based on the unit image capture range H2 that has been set, the CPU 61 uses the moving mechanism 40 to control the movement of the holder member 150, such that the gaps and the overlaps that occur between the plurality of the partial images will be less than the specified threshold value (Step S19). Therefore, when combining the plurality of the partial images, the sewing machine 1 may acquire a good composite image in which the gaps and the overlaps that occur between the partial images are suppressed.

The color reference member 153 includes the white color reference member 161. The sewing machine 1 may express properly the colors of the object of image capture (particularly white and colors that are close to white), based on the white color reference image that is captured of the white color reference member 161. The color reference member 153 includes the black color reference member 162. The sewing machine 1 may express properly the colors of the object of image capture (particularly black and colors that are close to black), based on the black color reference image that is captured of the black color reference member 162. More specifically, by performing the known shading correction using the first image data, the CPU 61 may acquire an image in which uneven coloring and uneven lighting have been reduced from what they were prior to the correction.

The white color reference image that was captured of the white color reference member 161 is corrected using the AWB (Step S5). The white color reference image expresses the color of the white color reference member 161 more appropriately than it could if it had not been corrected using the AWB. The white balance of the black color reference image that is captured of the black color reference member 162 and the white balance of the plurality of the partial images that are captured for the object of image capture are both adjusted using the same white balance values that are used for the white color reference image (Steps S15, S23).

Therefore, the sewing machine 1 may improve the correction precision for the first image data and the plurality of the partial images than it could in a case where it adjusted the white balance of the captured images using different white balance values for each image capture. In other words, the sewing machine 1 may create a composite image in which the colors are expressed appropriately, such that the coloring of the image is natural. Furthermore, by creating the embroidery data based on the composite image, the sewing machine 1 may sew an embroidery pattern that can express, in appropriate colors, the figure that was drawn on the object of image capture.

The sewing machine of the present disclosure is not limited to the embodiment that is described above, and various types of modifications can be made within the scope of the present disclosure. For example, the configuration of the sewing machine 1 may be modified as desired. The sewing machine 1 may be an industrial sewing machine, and may also be a multi-needle sewing machine. The image sensor 35 may also be a line sensor in which a plurality of image capture elements are arrayed in a main scanning direction. The color reference member 153 may also be a separate member, and it may also be provided on one of the embroidery frame and the needle plate 21 (refer to FIG. 2). The object of image capture is not limited to being a sheet shape, and it may also be the drawing area 158. In that case, the sewing machine 1 would be able to create the composite image and the embroidery data by capturing images of a figure that is drawn in the drawing area 158.

The pixel information that is used at Step S17 is not limited to the gray-scale value, and it may also be information that describes a different color space (for example, a known HSV, HLS, or the like). The method for correcting the image data at Step S25 may also be modified as desired. The color information in the image data may also be expressed by something other than the RGB gradation values. The reference pixel that is used at Step S55 is not limited to the pixel at the left edge of the gray-scale image, and it may also be a different pixel (for example, a pixel that the user has designated). At Step S63, the reference pixel may be changed without changing the corresponding pixel, and both the reference pixel and the corresponding pixel may be changed.

At Step S53, among the plurality of pixels that make up the gray-scale image, the mean value of the gray-scale values for the plurality of pixels that correspond to the same pixel number (that is, the plurality of pixels that are arrayed in the auxiliary scanning direction) may be specified as the gray-scale value for the object pixel that corresponds to that pixel number. In that case, the graph in FIG. 9 would show a state in which the mean value of the gray-scale values for the plurality of pixels that are arrayed in the auxiliary scanning direction of the gray-scale image would vary according to the position in the main scanning direction of the gray-scale image.

The program that contains instructions for performing the main processing (refer to FIG. 6) may also be stored in a storage device of the sewing machine 1 until the CPU 61 executes the program. Accordingly, the method for acquiring the program, the acquisition route, and the device that stores the program may vary as necessary. The programs that the CPU 61 executes may also be received from another device through a cable or by wireless communication, and then stored in a storage device such as a flash memory or the like. The other device may be a PC or a server that is connected through a network, for example.

The individual steps in the main processing (refer to FIG. 6) are not limited to the example in which they are executed by the CPU 61, and some or all of the steps may also be executed by a different electronic device (for example, an ASIC). The individual steps in the main processing may also be executed by distributed processing by a plurality of electronic devices (for example, a plurality of CPUs). The order of the individual steps in the main processing can be modified as necessary, and steps can also be omitted and added. An embodiment in which some or all of the main processing is performed by an operating system (OS) or the like that operates in the sewing machine 1, based on commands from the CPU 61, is included within the scope of the present disclosure.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

an image capture portion that is configured to capture images of an object region and a color reference member, the image capture portion having an image capture enabled range that is smaller than the object region, and the object region being configured such that an object of image capture is disposed within the object region;

a processor; and a memory that is configured to store computer-readable instructions, the computer-readable instructions, when executed by the processor, causing the sewing machine to perform the operations of:

setting a specified range within the image capture enabled range, based on a first image, the first image being an image of the color reference member that the image capture portion has captured, acquiring a plurality of partial images, the plurality of the partial images being a plurality of images that the image capture portion has captured, within the specified range that has been set, of a plurality of regions that are included in the object of image capture, and creating a composite image by combining the acquired plurality of the partial images.

2. The sewing machine according to claim 1, wherein the computer-readable instructions, when executed by the processor, further cause the sewing machine to perform the operation of:

acquiring the plurality of the partial images from a corresponding plurality of second images, the plurality of the second images being a plurality of images that the image capture portion has captured, within the image capture enabled range, of the plurality of the regions that are included in the object of image capture.

3. The sewing machine according to claim 1, wherein the computer-readable instructions, when executed by the processor, further cause the sewing machine to perform the operation of:

setting the specified range based on pixel information for each one of a plurality of pixels that make up the first image.

4. The sewing machine according to claim 3, wherein the image capture portion has a plurality of image capture elements that are arrayed in a main scanning direction and is configured to capture the partial images along an auxiliary scanning direction, and the computer-readable instructions, when executed by the processor, further cause the sewing machine to perform the operations of:

converting the first image to a gray-scale image, specifying a gray-scale value for each one of a plurality of object pixels in the converted gray-scale image, the plurality of the object pixels being a plurality of pixels that are arrayed in the main scanning direction, specifying a first pixel and a second pixel from among the plurality of the object pixels, based on the plurality of the gray-scale values that have been specified, the first pixel being a pixel that has a gray-scale value of a specified reference value, and the second pixel being a pixel that has a gray-scale value that is one of equal to the reference value and differs from the reference value by no more than a first threshold value, and setting the specified range as a range in which images are captured by a first image capture element, a second image capture element, and at least one third image capture element, among the plurality of the image capture elements, the first image capture element being an image capture element that corresponds to the first pixel, the second image capture element being an image capture element that corresponds to the second pixel, and the third image capture element being an image capture element that is disposed between the first image capture element and the second image capture element.

5. The sewing machine according to claim 4, wherein the computer-readable instructions, when executed by the processor, further cause the sewing machine to perform the operation of:

changing the second pixel to one of the plurality of the object pixels, in a case where a distance between the first pixel and the second pixel is less than a second threshold value, such that the distance between the first pixel and the second pixel will be not less than the second threshold value.

6. The sewing machine according to claim 1, further comprising:

a needle bar that is configured such that a sewing needle is mounted on its lower end; and a holder member that includes the object region, the holder member being disposed below the needle bar and being configured to hold the object of image capture.

7. The sewing machine according to claim 6, wherein the color reference member is provided as a single unit with the holder member.

8. The sewing machine according to claim 6, further comprising:

a moving portion that is configured to move the holder member, and wherein the computer-readable instructions, when executed by the processor, further cause the sewing machine to perform the operations of:

causing the image capture portion to capture the plurality of the partial images of the object of image capture, which moves in relation to the image capture portion in conjunction with the moving of the holder member by the moving portion, and controlling the moving of the holder member by the moving portion, based on the specified range that has been set, such that gaps and overlaps that occur between the plurality of the partial images become smaller than a third threshold value.

9. The sewing machine according to claim 1, wherein the color reference member includes a white color reference member.

10. The sewing machine according to claim 9, wherein the color reference member includes a black color reference member.

11. A non-transitory computer-readable medium that stores a program, the program including computer-readable instructions to be executed by a processor of a sewing machine, the sewing machine including an image capture portion, the image capture portion being configured to capture images of an object region and a color reference member, the image capture portion having an image capture enabled range that is smaller than the object region, the object region being configured such that an object of image capture is disposed within the object region, and the program including computer-readable instructions to cause the processor to perform the steps of:

setting a specified range within the image capture enabled range, based on a first image, the first image being an image of the color reference member that the image capture portion has captured, acquiring a plurality of partial images, the plurality of the partial images being a plurality of images that the image capture portion has captured, within the specified range that has been set, of a plurality of regions that are included in the object of image capture, and creating a composite image by combining the acquired plurality of the partial images.

12. The non-transitory computer-readable medium according to claim 11, wherein the program further includes computer-readable instructions to cause the processor to perform the step of:

acquiring the plurality of the partial images from a corresponding plurality of second images, the plurality of the second images being a plurality of images that the image capture portion has captured, within the image capture enabled range, of the plurality of the regions that are included in the object of image capture.

13. The non-transitory computer-readable medium according to claim 11, wherein the program further includes computer-readable instructions to cause the processor to perform the step of:

setting the specified range based on pixel information for each one of a plurality of pixels that make up the first image.

14. The non-transitory computer-readable medium according to claim 13, wherein the image capture portion has a plurality of image capture elements that are arrayed in a main scanning direction and is configured to capture the partial images along an auxiliary scanning direction, and the program further includes computer-readable instructions to cause the processor to perform the steps of:

converting the first image to a gray-scale image, specifying a gray-scale value for each one of a plurality of object pixels in the converted gray-scale image, the plurality of the object pixels being a plurality of pixels that are arrayed in the main scanning direction, specifying a first pixel and a second pixel from among the plurality of the object pixels, based on the plurality of the gray-scale values that have been specified, the first pixel being a pixel that has a gray-scale value of a specified reference value, and the second pixel being a pixel that has a gray-scale value that is one of equal to the reference value and differs from the reference value by no more than a first threshold value, and setting the specified range as a range in which images are captured by a first image capture element, a second image capture element, and at least one third image capture element, among the plurality of the image capture elements, the first image capture element being an image capture element that corresponds to the first pixel, the second image capture element being an image capture element that corresponds to the second pixel, and the third image capture element being an image capture element that is disposed between the first image capture element and the second image capture element.

15. The non-transitory computer-readable medium according to claim 14, wherein the program further includes computer-readable instructions to cause the processor to perform the step of:

changing the second pixel to one of the plurality of the object pixels, in a case where a distance between the first pixel and the second pixel is less than a second threshold value, such that the distance between the first pixel and the second pixel will be not less than the second threshold value.

16. The non-transitory computer-readable medium according to claim 11, wherein the sewing machine further includes a needle bar that is configured such that a sewing needle is mounted on its lower end, and a holder member that includes the object region, the holder member being disposed below the needle bar and being configured to hold the object of image capture.

17. The non-transitory computer-readable medium according to claim 16, wherein the color reference member is provided as a single unit with the holder member.

18. The non-transitory computer-readable medium according to claim 16, wherein the sewing machine further includes a moving portion that is configured to move the holder member, and the program further includes computer-readable instructions to cause the processor to perform the steps of:

causing the image capture portion to capture the plurality of the partial images of the object of image capture, which moves in relation to the image capture portion in conjunction with the moving of the holder member by the moving portion, and controlling the moving of the holder member by the moving portion, based on the specified range that has been set, such that gaps and overlaps that occur between the plurality of the partial images become smaller than a third threshold value.

19. The non-transitory computer-readable medium according to claim 11, wherein the color reference member includes a white color reference member.

20. The non-transitory computer-readable medium according to claim 19, wherein the color reference member includes a black color reference member.

* * * * *